US010679551B2

(12) United States Patent
Yang et al.

(10) Patent No.: US 10,679,551 B2
(45) Date of Patent: Jun. 9, 2020

(54) ORGANIC LIGHT EMITTING DISPLAY DEVICE HAVING GATE DRIVER CONFIGURED TO PROVIDE GROUP GATE SIGNALS

(71) Applicant: Samsung Display Co., Ltd., Yongin-Si, Gyeonggi-Do (KR)

(72) Inventors: Jin-Wook Yang, Suwon-si (KR); Soon-Dong Kim, Osan-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 16/028,960

(22) Filed: Jul. 6, 2018

(65) Prior Publication Data

US 2019/0043421 A1 Feb. 7, 2019

(30) Foreign Application Priority Data

Aug. 3, 2017 (KR) ..... 10-2017-0098728

(51) Int. Cl.
*G09G 5/10* (2006.01)
*G09G 3/3225* (2016.01)
(Continued)

(52) U.S. Cl.
CPC ..... *G09G 3/3225* (2013.01); *G09G 3/2074* (2013.01); *G09G 3/3233* (2013.01);
(Continued)

(58) Field of Classification Search
CPC .. G09G 3/3266; G09G 3/3225; G09G 3/2074; G09G 3/3233; G09G 3/3291; G09G 3/3208
(Continued)

(56) References Cited

U.S. PATENT DOCUMENTS

2008/0180369 A1 7/2008 Chiu et al.
2011/0090137 A1 4/2011 Liu et al.

(56) References Cited

2012/0105412 A1* 5/2012 Kang ..... G09G 3/3233 345/211
2014/0035797 A1* 2/2014 Jinta ..... G09G 3/30 345/77

(Continued)

FOREIGN PATENT DOCUMENTS

KR 10-2008-0002278 A 1/2008
KR 10-2008-0014331 A 2/2008

(Continued)

OTHER PUBLICATIONS

Extended European Search Report, Application No. 18187383.7, dated Oct. 4, 2018, 20 pages.

*Primary Examiner* — Adam J Snyder

(74) *Attorney, Agent, or Firm* — Innovation Counsel LLP

(57) ABSTRACT

An organic light emitting display device includes a display panel including pixel groups, each including a plurality of sub-pixels for each of pixel rows. A gate driver is configured to sequentially provide an initialization signal to the pixel rows, to provide a first group gate signal to first pixel groups of the pixel groups, to provide a second group gate signal overlapping at least a part of the first group gate signal to second pixel groups of the pixel groups, to sequentially provide the first group gate signal to the pixel rows, and to sequentially provide the second group gate signal to the pixel rows. An emission control driver is configured to sequentially provide an emission control signal to the pixel (Continued)

rows. A data driver is configured to output a data voltage. A data divider is configured to selectively provide the data voltage to data lines connected to the sub-pixels.

22 Claims, 21 Drawing Sheets

(51) Int. Cl.

| | |
|---|---|
| ***G09G 3/3233*** | (2016.01) |
| ***G09G 3/3266*** | (2016.01) |
| ***G09G 3/3291*** | (2016.01) |
| ***G09G 3/20*** | (2006.01) |
| *G09G 3/3208* | (2016.01) |

(52) U.S. Cl.
CPC ..... *G09G 3/3266* (2013.01); *G09G 3/3291* (2013.01); *G09G 3/3208* (2013.01); *G09G 2300/043* (2013.01); *G09G 2300/0452* (2013.01); *G09G 2300/0819* (2013.01); *G09G 2300/0861* (2013.01); *G09G 2310/0205* (2013.01); *G09G 2310/0297* (2013.01); *G09G 2320/0204* (2013.01); *G09G 2320/043* (2013.01)

(58) Field of Classification Search
USPC ..... 345/76; 315/169.3
See application file for complete search history.

(56) References Cited

U.S. PATENT DOCUMENTS

2014/0035890 A1* 2/2014 Jinta ..... G09G 3/20 345/204
2014/0035974 A1* 2/2014 Jinta ..... G09G 3/02 345/698
2014/0111406 A1* 4/2014 Wang ..... G09G 3/3233 345/77
2014/0139411 A1* 5/2014 Jinta ..... G09G 3/3233 345/80
2014/0198136 A1* 7/2014 Lee ..... G09G 3/3266 345/690
2014/0299843 A1* 10/2014 Kim ..... H01L 27/3265 257/40
2015/0009108 A1* 1/2015 Song ..... G09G 3/3225 345/80
2015/0187277 A1* 7/2015 Maeyama ..... G09G 3/3291 345/694
2017/0221419 A1* 8/2017 Xiang ..... G09G 3/3233
2017/0287396 A1* 10/2017 Akimoto ..... G09G 3/3233

FOREIGN PATENT DOCUMENTS

KR 10-2009-0070370 A 7/2009
KR 10-2011-0100840 A 9/2011
KR 10-2015-0077809 A 7/2015

* cited by examiner

ORGANIC LIGHT EMITTING DISPLAY DEVICE HAVING GATE DRIVER CONFIGURED TO PROVIDE GROUP GATE SIGNALS

CROSS REFERENCE TO RELATED APPLICATION

This application claims priority under 35 U.S.C. § 119 to Korean Patent Application No. 10-2017-0098728 filed on Aug. 3, 2017, the disclosure of which is hereby incorporated by reference herein in its entirety.

BACKGROUND

1. Technical Field

Example embodiments of the inventive concept relate to a display device. More particularly, example embodiments of the inventive concept relate to an organic light emitting display device capable of compensating a threshold voltage of a driving transistor.

2. Description of the Related Art

The display device displays an image based on light emitted by pixels. An organic light emitting display device includes pixels each having an organic light emitting diode (OLED). The organic light emitting display device includes a structure for compensating a threshold voltage of a driving transistor and initializing an anode of the OLED in the pixel to improve display quality by compensating luminance deviation between the pixels.

To solve problems caused by increasing a resolution of the organic light emitting display device such as increasing wirings included in the display panel, the output of the data driver can be controlled by a demultiplexer. For example, the demultiplexer supports that the data writing period is time-shared (e.g., time-divided into N:1) between adjacent data lines to reduce wirings in the display panel and output channels of the data driver, where N is an integer greater than 1.

However, in the high resolution display device, the compensating period of the threshold voltage of the driving transistor may be significantly reduced since the data signal is switched quickly by the demultiplexer. Therefore, the compensating period may not be secured sufficiently, and then display defects such as spots in the displayed image may be recognized.

SUMMARY

Example embodiments provide an organic light emitting display device capable of compensating a threshold voltage of a driving transistor by applying odd-numbered group gate signal and even-numbered group gate signal to each pixel row.

Example embodiments provide an organic light emitting display device capable of being driven at a high frequency and sufficiently securing a threshold voltage compensation period for each sub-pixel.

According to some example embodiments, an organic light emitting display device may include a display panel including a plurality of pixel groups. Each of the pixel groups includes a plurality of sub-pixels for each of pixel rows. A gate driver is configured to sequentially provide an initialization signal to the pixel rows, to provide a first group gate signal to first pixel groups of the pixel groups, to provide a second group gate signal overlapping at least a part of the first group gate signal to second pixel groups of the pixel groups, to sequentially provide the first group gate signal to the pixel rows, and to sequentially provide the second group gate signal to the pixel rows. An emission control driver is configured to sequentially provide an emission control signal to the pixel rows. A data driver is configured to output a data voltage. A data divider is configured to selectively provide the data voltage to data lines connected to the sub-pixels.

In example embodiments, a first group gate line for providing the first group gate signal may be solely connected to the first pixel groups. A second group gate line for providing the second group gate signal may be solely connected to the second pixel groups.

In example embodiments, the first pixel groups may correspond to odd-numbered pixel groups. The first group gate signal may correspond to an odd-numbered group gate signal. The second pixel groups may correspond to even-numbered pixel groups. The second group gate signal may correspond to an even-numbered group gate signal.

In example embodiments, a (k)th even-numbered group gate signal corresponding to a (k)th pixel row may be delayed by a ½ horizontal period from a (k)th odd-numbered group gate signal corresponding to the (k)th pixel row, where k is an integer greater than 0.

In example embodiments, a (k)th odd-numbered group gate signal corresponding to a (k)th pixel row may be delayed by a ½ horizontal period from a (k)th even-numbered group gate signal corresponding to the (k)th pixel row, where k is an integer greater than 0.

In example embodiments, each of the sub-pixels included in the first pixel groups may include a first transistor connected between one of the data lines and a first node, the first transistor including a gate electrode configured to receive the odd-numbered group gate signal. A driving transistor is connected between the first node and a second node, the driving transistor including a gate electrode connected to a third node. A second transistor is connected between the second node and the third node, the second transistor including a gate electrode configured to receive the odd-numbered group gate signal. A third transistor is connected between the third node and an initialization power source, the third transistor including a gate electrode configured to receive the initialization signal. A fourth transistor is connected between a first power source and the first node, the fourth transistor including a gate electrode configured to receive the emission control signal. A fifth transistor is connected between the second node and a fourth node, the fifth transistor including a gate electrode configured to receive the emission control signal. A sixth transistor is connected between the initialization power source and the fourth node, the sixth transistor including a gate electrode configured to receive the initialization signal. A capacitor is connected between the first power source and the third node. An organic light emitting diode (OLED) is connected between the fourth node and a second power source configured to provide a voltage lower than a voltage of the first power source.

In example embodiments, each of the sub-pixels included in the second pixel groups may include a first transistor connected between one of the data lines and a first node, the first transistor including a gate electrode configured to receive the even-numbered group gate signal. A driving transistor is connected between the first node and a second node, the driving transistor including a gate electrode connected to a third node. A second transistor is connected between the second node and the third node, the second transistor including a gate electrode configured to receive the even-numbered group gate signal. A third transistor is connected between the third node and an initialization power source, the third transistor including a gate electrode configured to receive the initialization signal. A fourth transistor is connected between a first power source and the first node, the fourth transistor including a gate electrode configured to receive the emission control signal. A fifth transistor is connected between the second node and a fourth node, the fifth transistor including a gate electrode configured to receive the emission control signal. A sixth transistor is connected between the initialization power source and the fourth node, the sixth transistor including a gate electrode configured to receive the initialization signal. A capacitor is connected between the first power source and the third node. An organic light emitting diode (OLED) is connected between the fourth node and a second power source configured to provide a voltage lower than a voltage of the first power source.

In example embodiments, a single frame period for each of the pixel rows may include an initialization period in which a voltage of the third node and a voltage of the fourth node are simultaneously initialized, a compensation period in which the data voltage is written and a threshold voltage of the driving transistor is compensated after the initialization period, and an emission period in which each of the pixel rows emits light after the compensation period.

In example embodiments, the first transistor and the second transistor may be turned-on during the compensation period. The compensation period may include a first compensation period during which the threshold voltage of the driving transistor is compensated by applying the data voltage to the driving transistor via one of the data lines, and a second compensation period during which the one of the data lines is in a floating state and the operation of compensating the threshold voltage of the driving transistor is maintained.

In example embodiments, a (k)th odd-numbered group gate line for providing a (k)th odd-numbered group gate signal to a (k)th pixel row may be disposed farther from the first and second transistors of the sub-pixels included in the (k)th pixel row than a (k)th even-numbered group gate line for providing a (k)th even-numbered group gate signal to the (k)th pixel row, where k is an integer greater than 0. The (k)th odd-numbered group gate line may be connected to the gate electrodes of the first and second transistors included in each of the sub-pixels of the odd-numbered pixel groups by a bridge structure. A (k+1)th even-numbered group gate line for providing a (k+1)th even-numbered group gate signal to a (k+1)th pixel row may be disposed farther from the first and second transistors of the sub-pixels included in the (k+1)th pixel row than a (k+1)th odd-numbered group gate line for providing a (k+1)th odd-numbered group gate signal to the (k+1)th pixel row. The (k+1)th even-numbered group gate line may be connected to the gate electrodes of the first and second transistors included in each of the sub-pixels of the even-numbered pixel groups by the bridge structure.

In example embodiments, a length of an activation period of the first group gate signal and a length of an activation period of the second group gate signal may be different from each other.

In example embodiments, each of the pixel groups may include a first sub-pixel, a second sub-pixel, a third sub-pixel, and a fourth sub-pixel arranged in a first direction in which the pixel rows extend.

In example embodiments, a first data line connected to the first sub-pixel and a second data line connected to the second sub-pixel may extend in a second direction in which pixel columns extend, the first data line and the second data line disposed between the first sub-pixel and the second sub-pixel. A third data line connected to the third sub-pixel and a fourth data line connected to the fourth sub-pixel may extend in the second direction, the third data line and the fourth data line disposed between the third sub-pixel and the fourth sub-pixel. The data lines may be not disposed between the second sub-pixel and the third sub-pixel and between the pixel groups.

In example embodiments, sub-pixels adjacent to each other in the first direction may have structures symmetrical in the second direction.

According to some example embodiments, an organic light emitting display device may include a display panel including a plurality of pixel groups, each of the pixel groups including a plurality of sub-pixels. A gate driver is configured to provide a first group gate signal to first pixel groups in a first pixel row, to provide a second group gate signal to second pixel groups adjacent to the first pixel groups in the first pixel row, to provide a third group gate signal to third pixel groups in a second pixel row adjacent to the first pixel row, and to provide a fourth group gate signal to fourth pixel groups adjacent to the third pixel groups in the second pixel row. an emission control driver is configured to provide a first emission control signal to the first pixel row and to provide a second emission control signal to the second pixel row. A data driver is configured to output a data voltage. A data divider is configured to selectively provide the data voltage to a first group data line connected to the first pixel groups, a second group data line connected to the second pixel groups, a third group data line connected to the third pixel groups, and a fourth group data line connected to the fourth pixel groups.

In example embodiments, a first group gate line for providing the first group gate signal may be solely connected to the first pixel groups in the first pixel row. A second group gate line for providing the second group gate signal may be solely connected to the second pixel groups in the first pixel row. A third group gate line for providing the third group gate signal may be solely connected to the third pixel groups in the second pixel row. A fourth group gate line for providing the fourth group gate signal may be solely connected to the fourth pixel groups in the second pixel row.

In example embodiments, the first pixel row may be an odd-numbered pixel row. The second pixel row may be an even-numbered pixel row and is adjacent to the first pixel row. Each of the first and third pixel groups may correspond to odd-numbered pixel groups. Each of the second and fourth pixel groups may correspond to even-numbered pixel groups.

In example embodiments, a data writing and threshold voltage compensating operation for the sub-pixels may be performed in an order of the first pixel groups of a (2k−1)th pixel row, the second pixel groups of the (2k−1)th pixel row, the fourth pixel groups of a (2k)th pixel row, and the third pixel groups of the (2k)th pixel row, where k is an integer greater than 0.

In example embodiments, the second group gate signal corresponding to a (2k−1)th pixel row may be delayed by a ½ horizontal period from the first group gate signal corresponding to the (2k−1)th pixel row, where k is an integer greater than 0. The fourth group gate signal corresponding to a (2k)th pixel row may be delayed by the ½ horizontal period from the second group gate signal corresponding to the (2k−1)th pixel row. The third group gate signal corresponding to the (2k)th pixel row may be delayed by the ½ horizontal period from the fourth group gate signal corresponding to the (2k)th pixel row.

In example embodiments, a data writing and threshold voltage compensating operation for the sub-pixels may be performed in an order of the second pixel groups of a (2k−1)th pixel row, the first pixel groups of the (2k−1)th pixel row, the third pixel groups of a (2k)th pixel row, and the fourth pixel groups of the (2k)th pixel row, where k is an integer greater than 0.

In example embodiments, a data writing and threshold voltage compensating operation for the sub-pixels may be performed in an order of the third pixel groups of a (2k)th pixel row, the fourth pixel groups of the (2k)th pixel row, the second pixel groups of a (2k−1)th pixel row, and the first pixel groups of the (2k−1)th pixel row, where k is an integer greater than 0.

In example embodiments, a data writing and threshold voltage compensating operation for the sub-pixels may be performed in an order of the fourth pixel groups of a (2k)th pixel row, the third pixel groups of the (2k)th pixel row, the first pixel groups of a (2k−1)th pixel row, and the second pixel groups of the (2k−1)th pixel row, where k is an integer greater than 0.

In example embodiments, a compensation period in which a data writing and threshold voltage compensating operation for the sub-pixels is performed may include a first compensation period during which a threshold voltage of a driving transistor is compensated by applying the data voltage to the driving transistor of one of the sub-pixels, and a second compensation period during which a data line corresponding to one of the sub-pixels is in a floating state and the operation of compensating the threshold voltage is maintained.

In example embodiments, a gate voltage of the driving transistor and an anode voltage of an organic light emitting diode in each of the sub-pixels included in each of pixel rows may be simultaneously initialized. The entire sub-pixels included in each of the pixel rows simultaneously may emit light.

In example embodiments, a first group gate line connected to the first pixel groups of a (2k−1)th pixel row may be disposed farther from the (2k−1)th pixel row than a second group gate line connected to the second pixel groups of the (2k−1)th pixel row, where k is an integer greater than 0. The first group gate line may be connected to each of the sub-pixels in the first pixel groups by a bridge structure. A fourth group gate line connected to the fourth pixel groups of a (2k)th pixel row may be disposed farther from the (2k)th pixel row than a third group gate line connected to the third pixel groups of the (2k)th pixel row. The fourth group gate line may be connected to each of the sub-pixels in the fourth pixel groups by the bridge structure.

In example embodiments, a second group gate line connected to the second pixel groups of a (2k−1)th pixel row may be disposed farther from the (2k−1)th pixel row than a first group gate line connected to the first pixel groups of the (2k−1)th pixel row, where k is an integer greater than 0. The second group gate line may be connected to each of the sub-pixels in the second pixel groups by a bridge structure. A third group gate line connected to the third pixel groups of a (2k)th pixel row may be disposed farther from the (2k)th pixel row than a fourth group gate line connected to the fourth pixel groups of the (2k)th pixel row. The third group gate line may be connected to each of the sub-pixels in the third pixel groups by the bridge structure.

Therefore, an organic light emitting display device according to example embodiments commonly provides the emission control signal and the initialization signal to each pixel row, and separately provides an odd-numbered group gate signal to odd-numbered pixel groups and an even-numbered group gate signal to even-numbered pixel groups as the gate signal. The odd-numbered group gate signal overlaps at least a part of the even-numbered group gate signal. Accordingly, the compensation time for compensating the threshold voltage of the driving transistor can be sufficiently secured, thereby preventing display defects such as spots in displayed image and improving the display quality of a high resolution display device or a display device driven using demultiplexers.

In addition, odd-numbered group gate lines and even-numbered group gate lines are disposed at opposite positions on neighboring pixel rows, thereby preventing image deviations.

BRIEF DESCRIPTION OF THE DRAWINGS

Exemplary embodiments will be described more fully hereinafter with reference to the accompanying drawings, in which various embodiments are shown.

DESCRIPTION OF EMBODIMENTS

Exemplary embodiments will be described more fully hereinafter with reference to the accompanying drawings, in which various embodiments are shown.

Figure 1:
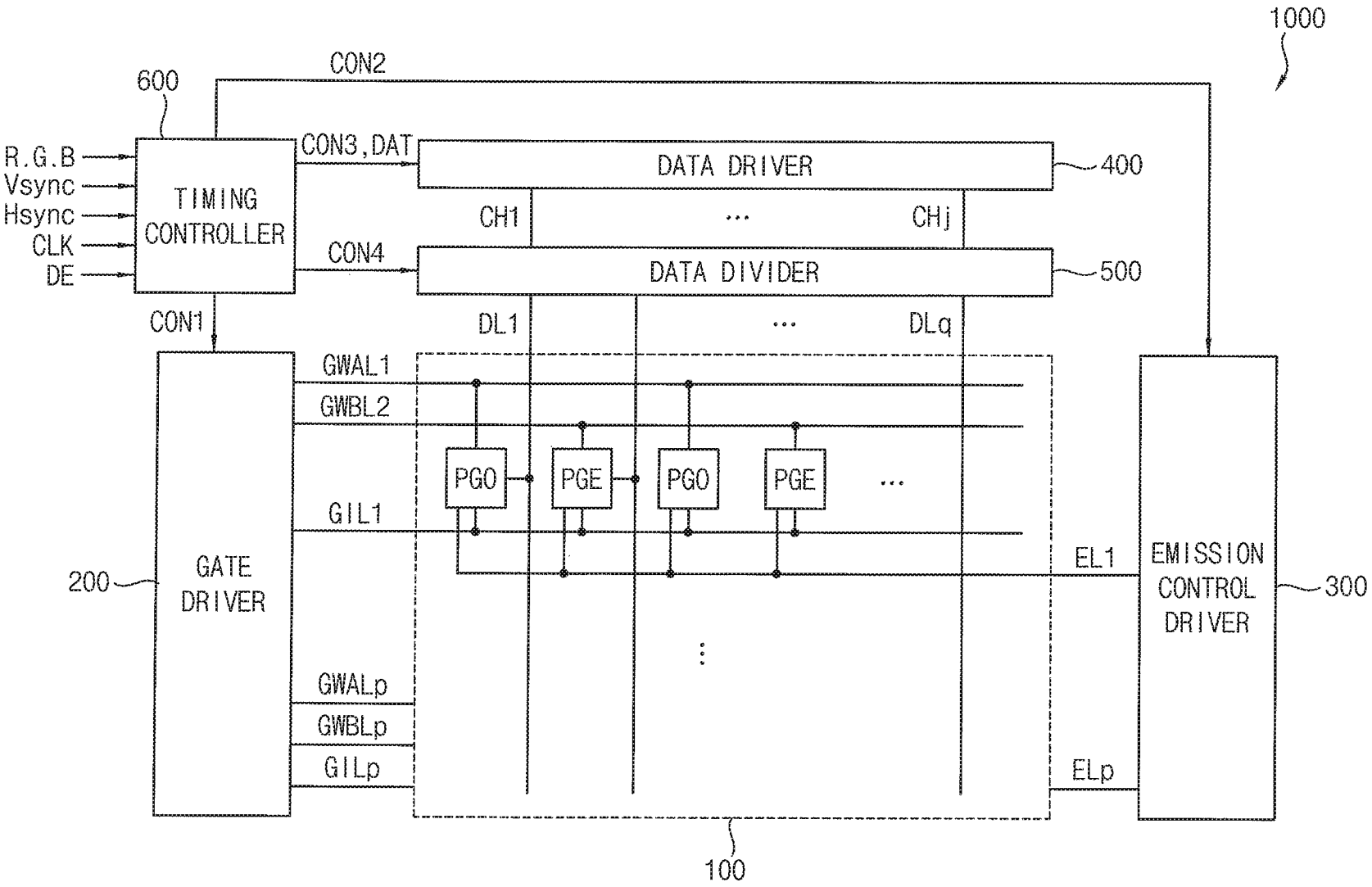
FIG. 1 is a block diagram illustrating an organic light emitting display device according to example embodiments.
Figure 2:
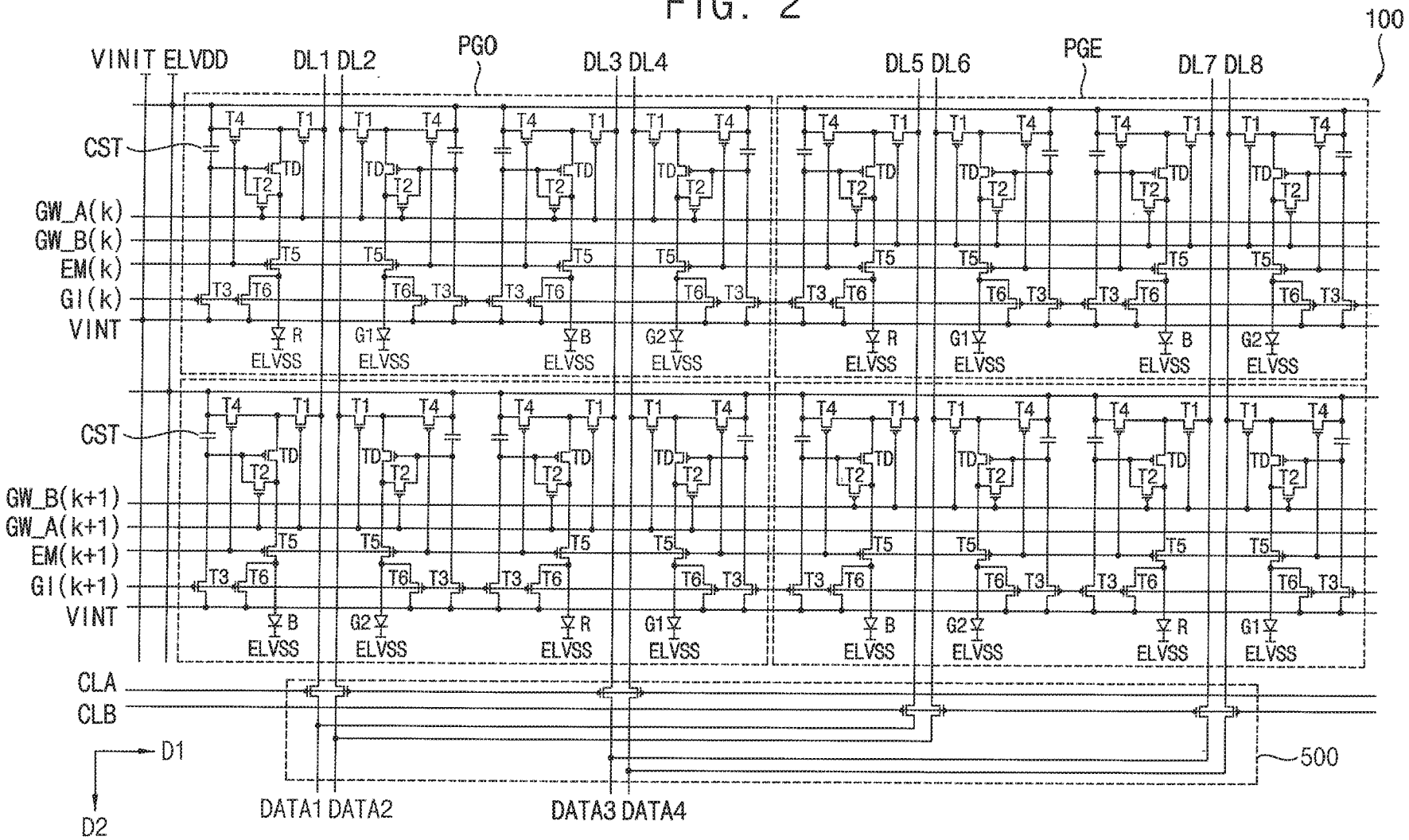
FIG. 2 is a circuit diagram illustrating an example of a display panel included in the organic light emitting display device of FIG. 1.

FIG. 1 is a block diagram illustrating an organic light emitting display device 1000 according to example embodiments. FIG. 2 is a circuit diagram illustrating an example of a display panel 100 included in the organic light emitting display device 1000 of FIG. 1.

Referring to FIGS. 1 and 2, the organic light emitting display device 1000 may include the display panel 100, a gate driver 200, an emission control driver 300, a data driver 400, a data divider 500, and a timing controller 600.

The organic light emitting display device 1000 may be a flat display device, a flexible display device, a curved display device, a foldable display device, or a bendable display device. Further, the display device 1000 can be applied to a transparent display device, a head-mounted display device, a wearable display device, etc.

The display panel 100 may include a plurality of pixel rows. Each of the pixel rows may include a plurality of pixel groups PGO, PGE. Each of the pixel groups PGO, PGE may include a plurality of sub-pixels. The sub-pixels may be arranged in a matrix form of p rows*q columns, where p and q represent integers greater than 1. Each of the sub-pixels may receive a gate signal, an initialization signal, an emission control signal, and a data signal to be driven.

In one example embodiment, the pixel groups PGO, PGE included in single pixel row may be divided into a first pixel group and a second pixel group. For example, the first pixel group may be defined as an odd-numbered pixel group PGO, and the second pixel group may be defined as an even-numbered pixel group PGE. However, the manner of distinguishing the pixel groups is not limited thereto. For example, some of the first pixel groups (or some of the second pixel groups) may be arranged continuously. In one example, the first number of the first pixel groups in single pixel row may be equal to the second number of the second pixel groups in single pixel row. In another example, the first number of the first pixel groups in single pixel row may be different from the second number of the second pixel groups in single pixel row.

Hereinafter, it is assumed that the first pixel group is the odd-numbered pixel group PGO and the second pixel group is the even-numbered pixel group PGE.

Each of the odd-numbered pixel group PGO and the even-numbered pixel group PGE may include four sub-pixels. For example, each of the pixel groups PGO, PGE may include a red sub-pixel, a blue sub-pixel, and two green sub-pixels. However, the number of sub-pixels included in each of the pixel groups PGO, PGE is not limited thereto.

In addition, as shown in FIGS. 1 and 2, the odd-numbered pixel groups PGO may be connected to the first group gate lines (e.g., odd-numbered group gate lines GWAL1 to GWALp). Also, the even-numbered pixel groups PGE may be connected to the second group gate lines (e.g., even-numbered group gate lines GWBL1 to GWBLp). In other words, the sub-pixels connected to the odd-numbered group gate lines GWAL1 to GWALp, which are the first group gate lines, may be defined as the odd-numbered pixel group PGO. Also, the sub-pixels connected to the even-numbered group gate lines GWBL1 to GWBLp, which are the second group gate lines, may be defined as the even-numbered pixel group PGE.

Each of the sub-pixels may include a driving transistor TD and a plurality of switch transistors T1, T2, T3, T4, T5, and T6. Each of the sub-pixels may be connected to one of the odd-numbered group gate lines GWAL1 to GWALp or one of even-numbered group gate lines GWBL1 to GWBLp.

The timing controller 600 may receive image data R.G.B, a vertical synchronization signal Vsync, a horizontal synchronization signal Hsync, a main clock signal CLK, and a data enable signal DE, etc. The timing controller 600 may generate a gate driver control signal CON1, an emission driver control signal CON2, a data driver control signal CON3, a data divider control signal CON4, and output image data DAT corresponding the image data R.G.B based on above signals. The timing controller 600 may provide the gate driver control signal CON1 to the gate driver 200, provide the output image data DAT and the data driver control signal CON3 to the data driver 400, provide the emission driver control signal CON2 to the emission control driver 300, and provide the data divider control signal CON4 to the data divider 500.

The gate driver 200 may sequentially provide the initialization signal to initialization lines GIL1 to GILp based on the gate driver control signal CON1 provided from the timing controller 600. Each of the initialization lines GIL1 to GILp may be connected to the pixel rows respectively. As shown in FIG. 2, the (k)th initialization line transferring the (k)th initialization signal GI(k) may be connected to entire sub-pixels of the (k)th pixel row, where k is a positive integer less than or equal to p.

In addition, the gate driver 200 may sequentially provide the first group gate signal to the first group gate lines and sequentially provide the second group gate signal to the second group gate lines based on the gate driver control signal CON1. In one example embodiment, when the first group gate lines correspond to odd-numbered group gate lines GWAL1 to GWALp, the first group gate signal may correspond to an odd-numbered group gate signal. When the second group gate lines correspond to even-numbered group gate lines GWBL1 to GWBLp, the second group gate signal may correspond to an even-numbered group gate signal. Here, the odd-numbered group gate signal and the even-numbered group gate signal that are applied to the same pixel row may partially overlap each other.

In one example embodiment, the even-numbered group gate signal may be delayed by ½ horizontal period from the odd-numbered group gate signal. In another example embodiment, the odd-numbered group gate signal may be delayed by ½ horizontal period from the even-numbered group gate signal.

As shown in FIG. 2, the (k)th odd-numbered group gate line transferring the (k)th odd-numbered group gate signal GW_A(k) may be connected to the odd-numbered pixel group PGO of the (k)th pixel row. Also, the (k)th even-numbered group gate line transferring the (k)th even-numbered group gate signal GW_B(k) may be connected to the even-numbered pixel group PGE of the (k)th pixel row.

The emission control driver 300 may sequentially provide the emission control signal to emission control lines EL1 to ELn based on the emission driver control signal CON2. Each of the emission control lines EL1 to ELn may be connected to the pixel rows respectively. As shown in FIG. 2, the (k)th emission control line transferring the (k)th emission control signal EM(k) may be connected to the entire sub-pixels of the (k)th pixel row.

The data driver 400 may provide the data signal (or data voltage) to a plurality of output lines CH1 to CHj based on the data driver control signal CON3 and the output image data DAT provided from the timing controller 600, where j is a positive integer smaller than q.

The data divider 500 may selectively provide the data voltage to data lines DL1 to DLq connected to the sub-pixels based on the data divider control signal CON4 such that a single output line is time-shared by some of the data lines. In one example embodiment, the data divider 500 may include a plurality of demultiplexers. For example, each demultiplexer may transfer the data voltage from one output line to one of N data lines through N switches (e.g., switch transistors), where N is an integer between 2 and 6. Thus, the organic light emitting display device 1000 may provide the data voltages to the sub-pixels by the demultiplexers (hereinafter, referred to as the DEMUX driving manner).

As shown in FIG. 2, the data divider 500 may include a plurality of switch transistors connected to the data lines DL1 to DL8 and may receive data voltages DATA1 to DATA4 from the data driver 400 (e.g., latches of the data driver 400). The switch transistors included in the data divider 500 may be controlled by the clock signals CLA and CLB of which phase have a half period difference (e.g., have opposite phases to each other). For example, when the first clock signal CLA has an activation level (or turn-on level), the data voltages may be provided to the first to fourth data lines DL1 to DL4 and data voltage may be applied (or written) to the sub-pixels of the odd-numbered pixel group PGO. When the second clock signal CLB has the activation level, the data voltages may be provided to the fifth to eighth data lines DL5 to DL8 and data voltage may be applied (or written) to the sub-pixels of the even-numbered pixel group PGE.

In one example embodiment, the first data line DL1 connected to the first sub-pixel and the second data line DL2 connected to the second sub-pixel may be arranged in a second direction D2 in which pixel columns extend. The first data line DL1 and the second data line DL2 may be disposed between the first sub-pixel and the second sub-pixel. The third data line DL3 connected to the third sub-pixel and the fourth data line DL4 connected to the fourth sub-pixel may be arranged in the second direction D2. The third data line DL3 and the fourth data line DL4 may be disposed between the third sub-pixel and the fourth sub-pixel. In addition, the data lines may be not disposed between the second sub-pixel and the third sub-pixel and between the pixel groups PGO, PGE. Accordingly, a coupling effect between the data lines due to writing the data voltage can be reduced.

As described above, the organic light emitting display device 1000 according to example embodiments may commonly provide the emission control signal EM(k) and the initialization signal GI(k) to entire sub-pixels of single pixel row. Also, the organic light emitting display device 1000 may provide the odd-numbered group gate signal to odd-numbered pixel group solely, and then may provide the even-numbered group gate signal to even-numbered pixel group solely. Accordingly, a time for compensating the threshold voltage of the driving transistor TD in the sub-pixel may be sufficiently secured. Therefore, the compensating operation of the threshold voltage may be sufficiently performed in every frame, thereby preventing a stain occurred in high-resolution display device and improving the display quality.

In addition, in the organic light emitting display device 1000 according to example embodiments, the coupling effect between the data lines due to writing the data voltage can be reduced by arranging the data lines.

Figure 3:
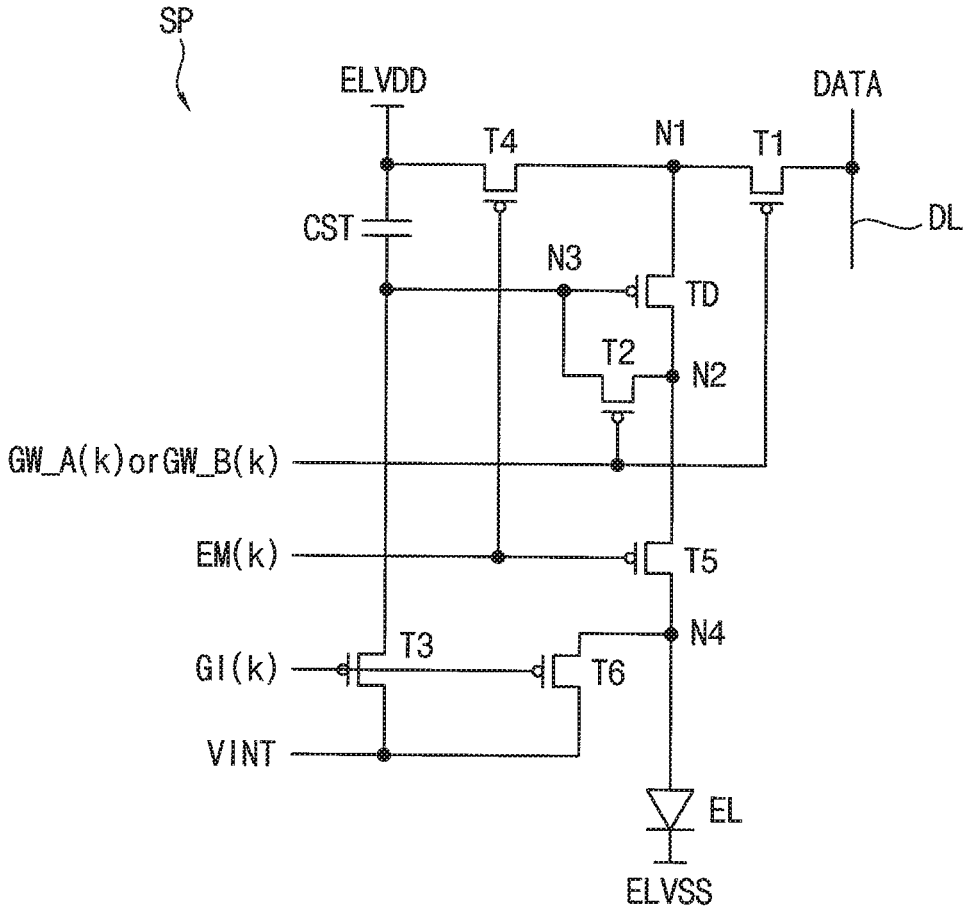
FIG. 3 is a circuit diagram illustrating an example of a sub-pixel included in the display panel of FIG. 2.
Figure 4:
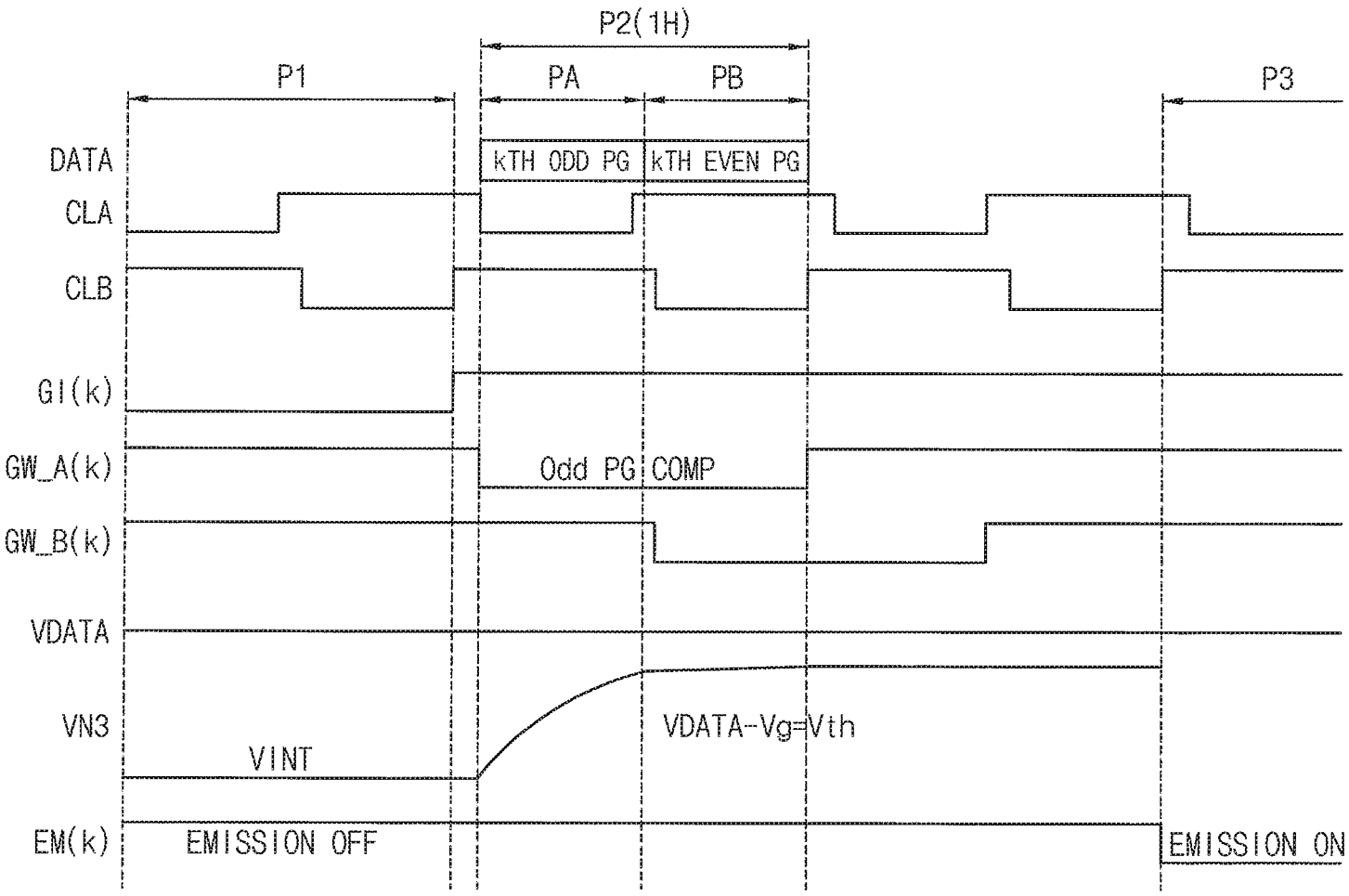
FIG. 4 is a timing diagram illustrating an example in which the sub-pixel of FIG. 3 is driven in a compensation period.

FIG. 3 is a circuit diagram illustrating an example of a sub-pixel SP included in the display panel of FIG. 2. FIG. 4 is a timing diagram illustrating an example in which the sub-pixel SP of FIG. 3 is driven in a compensation period.

Referring to FIGS. 3 and 4, each sub-pixel SP may include a driving transistor TD, first through sixth transistors T1 through T6, a storage capacitor CST, and an organic light emitting diode EL.

The driving transistor TD may provide a driving current corresponding to a data signal (or data voltage) DATA to the organic light emitting diode EL. The driving transistor TD may be connected between a first node N1 and a second node N2. A gate electrode of the driving transistor TD may be connected to the third node N3.

The first transistor T1 may provide the data signal DATA to the first node N1 in response to a first group gate signal (e.g., odd-numbered group gate signal GW_A(k)) or a second group gate signal (e.g., even-numbered group gate signal GW_B(k)). The first transistor T1 may be connected between the data line and the first node N1. A gate electrode of the first transistor T1 may receive the odd-numbered group gate signal GW_A(k) or the even-numbered group gate signal GW_B(k). When the sub-pixel SP corresponds to the odd-numbered pixel group, the first transistor T1 may receive the odd-numbered group gate signal GW_A(k). When the sub-pixel SP corresponds to the even-numbered pixel group, the first transistor T1 may receive the even-numbered group gate signal GW_B(k).

The second transistor T2 may connect the second node N2 to a third node N3 (i.e., connect the second electrode of the driving transistor TD to the gate electrode of the driving transistor TD) in response to the odd-numbered group gate signal GW_A (k) or the even-numbered group gate signal GW_B(k). The second transistor T2 may be connected between the second node N2 and the third node N3. A gate electrode of the second transistor T2 may receive the odd-numbered group gate signal GW_A(k) or the even-numbered group gate signal GW_B(k). When the sub-pixel SP corresponds to the odd-numbered pixel group, the second transistor T2 may receive the odd-numbered group gate signal GW_A(k). When the sub-pixel SP corresponds to the even-numbered pixel group, the second transistor T2 may receive the even-numbered group gate signal GW_B(k).

The second transistor T2 may be used for compensating a threshold voltage of the driving transistor TD. A diode-connection of the driving transistor TD may be formed when the second transistor T2 is turned-on. Accordingly, a compensating operation for the threshold voltage of the driving transistor TD may be performed.

The third transistor T3 may provide an initialization voltage VINT to the third node N3 (i.e., the gate electrode of the driving transistor TD) in response to an initialization signal GI(k). The third transistor T3 may be connected between an initialization power source and the third node N3. A gate electrode of the third transistor T3 may receive the initialization signal GI(k). The third transistor T3 may be used to initialize the gate voltage of the driving transistor TD to the initializing voltage VINT.

The fourth transistor T4 may provide the first power voltage ELVDD to the first node N1 in response to an emission control signal EM(k). The fourth transistor T4 may be connected between the first node N1 and a first power source providing the first power voltage ELVDD. A gate electrode of the fourth transistor T4 may receive the emission control signal EM(k).

The fifth transistor T5 may electrically connect the driving transistor TD to an anode electrode of the organic light emitting diode EL in response to the emission control signal EM(k). The fifth transistor T5 may be connected between the second node N2 and a fourth node N4. A gate electrode of the fifth transistor T5 may receive the emission control signal EM(k).

The sixth transistor T6 may provide the initialization voltage VINT to the fourth node N4 (i.e., the anode electrode of the organic light emitting diode EL) in response to the initialization signal GI(k). The sixth transistor T6 may be connected between the initialization power source and the fourth node N4. A gate electrode of the sixth transistor T6 may receive the initialization signal GI(k). The sixth transistor T6 may be used to initialize the voltage of the anode electrode of the organic light emitting diode EL to the initializing voltage VINT.

The storage capacitor CST may be connected between the first power source and the third node N3.

The organic light emitting diode EL may be connected between the fourth node N4 and a second power source providing a second power voltage ELVSS. The second power voltage ELVSS may be lower than the first power voltage ELVDD.

Hereinafter, it is assumed that the sub-pixel SP is arranged in the first pixel group (for example, the odd-numbered pixel group) of the (k)th pixel row to describe method of driving the sub-pixel SP.

As shown in FIG. 4, a single frame period for driving the sub-pixel SP may include an initialization period P1 in which a voltage Vg of the gate electrode of the driving transistor TD and a voltage of the anode electrode of the organic light emitting diode EL are initialized, a compensation period P2 in which the data voltage is written and the threshold voltage of the driving transistor TD is compensated, and an emission period P3 in which the sub-pixel SP emits light.

In the initialization period P1, the initialization signal GI(k) may correspond to the activation level and the gate signals GW_A(k) and GW_B(k) may correspond to the deactivation level. In one example of FIG. 4, the activation level may be a logic low level, and the deactivation level may be a logic high level. Accordingly, because the third transistor T3 may be turned on, the voltage Vg of the gate electrode of the driving transistor TD (i.e., a voltage VN3 of the third node) may be initialized to the initializing voltage VINT. Also, because the sixth transistor T6 may be turned on, the voltage of the anode electrode of the organic light emitting diode EL (i.e., a voltage of the fourth node) may be initialized to the initializing voltage VINT. The emission control signal EM(k) may correspond to the deactivation level during the initialization period P1.

In the compensation period P2, the odd-numbered group gate signal GW_A(k) may correspond to the activation level. The odd-numbered group gate signal GW_A(k) may be provided through the odd-numbered group gate line connected to the sub-pixel SP. The second transistor T2 and the third transistor T3 may be turned on during the compensation period P2. Therefore, the diode connection of the driving transistor TD may be formed. In the compensation period P2, the initialization signal GI(k) and the emission control signal EM(k) may correspond to the deactivation level.

The compensation period P2 may include a first compensation period PA in which the data voltage VDATA is applied to the driving transistor TD through the data line DL to write the data voltage VDATA and compensate the threshold voltage of the driving transistor TD, and a second compensation period PB in which the threshold voltage compensating operation is maintained by the data line DL in a floating status. The data signal DATA corresponding to the data voltage VDATA may be set every about ½ horizontal period in synchronization with the first and second clock signals CLA and CLB. Therefore, as shown in FIG. 2, the data line DL, of which connection with the sub-pixel SP is controlled by the first clock signal CLA, may transfer the data voltage VDATA to the sub-pixel SP only during the first compensation period PA.

During the first compensation period PA, the data voltage VDATA may be applied to the sub-pixel SP, and then the threshold voltage of the driving transistor TD may be compensated. For example, during the compensation period P2, the gate electrode of the driving transistor TD and the second electrode of the driving transistor TD are connected to each other (i.e., diode-connection), and then the data voltage VDATA is applied to the first electrode of the driving transistor TD. Accordingly, a voltage of the gate electrode of the driving transistor TD may be determined based on the data voltage VDATA and the threshold voltage of the driving transistor TD such that the driving current is determined based on the data voltage VDATA regardless of the threshold voltage of the driving transistor TD. When the display device has a high-resolution or the display device is driven at high-frequency, the first compensation period PA is relatively short (e.g., lesser than 3 microsecond). Accordingly, the compensation of the threshold voltage may not be sufficiently performed.

During the second compensation period PB, the data line DL may be in floating status because the first clock signal CLA corresponds to the deactivation level. During the second compensation period PB, the compensating operation of the threshold voltage may be maintained by the voltage remaining (or stored) in the floating data line DL. Therefore, the sub-pixel SP may sufficiently perform the compensating operation of the threshold voltage within one horizontal period (1H).

In this case, because the driving transistor TD is turned off (or almost turned off) during the second compensation period PB, the voltage of the gate electrode of the driving transistor TD may not affected by a change in the data signal DATA by the first and second clock signals CLA and CLB. Therefore, a time for compensating the threshold voltage may be sufficiently secured because the compensation period P2 includes the first compensation period PA during which the data voltage VDATA is applied to the driving transistor TD and the second compensation period PB during which the compensating operation of the threshold voltage is maintained by the voltage of the floating data line DL.

In one example embodiment, the even-numbered group gate signal GW_B(k) may correspond to the activation level in the second compensation period PB. Therefore, in the second compensation period PB, the sub-pixels of the even-numbered pixel group of the (k)th pixel row may perform the compensating operation of the threshold voltage by applying the data voltage VDATA to the driving transistor TD.

Thereafter, in the emission period P3, the emission control signal EM(k) may correspond to the activation level. The fourth and fifth transistors T4 and T5 may be turned on. Accordingly, the organic light emitting diode EL may emit light with a luminance corresponding to the data voltage VDATA during the emission period P3.

As described above, the sub-pixel SP included in the organic light emitting display device 1000 driven in the DEMUX driving manner may perform the compensating operation sufficiently during the first compensation period PA in which the data voltage VDATA is applied to the sub-pixel and the second compensation period PB in which the threshold voltage compensation is maintained by the voltage remaining in the floating data line DL. Therefore, the time for compensating the threshold voltage may be sufficiently ensured in the high-resolution display device in which one horizontal period (1H) is relatively short, thereby preventing stains and improving the display quality.

Figure 5:
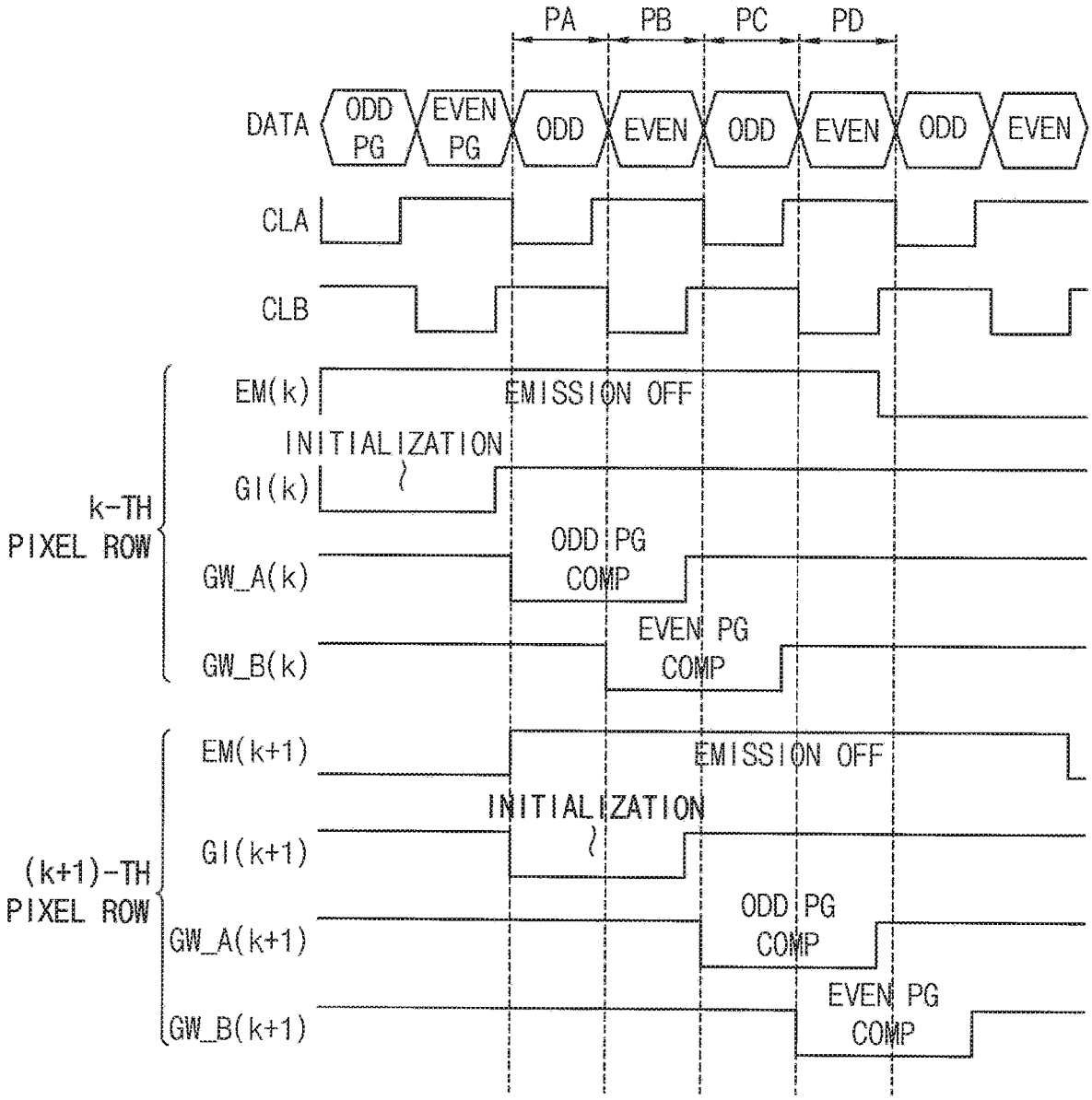
FIG. 5 is a timing diagram illustrating one example of signals for driving the display panel of FIG. 2.

FIG. 5 is a timing diagram illustrating one example of signals for driving the display panel of FIG. 2.

Referring to FIG. 5, the first pixel group and the second pixel group of the (k)th pixel row may simultaneously perform initialization operation and emission operation, and may independently perform data writing and threshold voltage compensating operation. Here, the first pixel group may be an odd-numbered pixel group, and the second pixel group may be an even-numbered pixel group. The first group gate signal applied to the (k)th pixel row may be the (k)th odd-numbered group gate signal GW_A (k), and the second group gate signal applied to the (k)th pixel row may be the (k)th even-numbered group gate signal GW_B(k).

The (k)th initialization signal GI(k) corresponding to the activation level may be applied to entire sub-pixels in the (k)th pixel row commonly. Therefore, the initialization operation may be simultaneously performed in entire sub-pixels in the (k)th pixel rows.

The (k)th odd-numbered group gate signal GW_A(k) may correspond to the activation level during the first and second compensation periods PA, PB. Therefore, the data writing and threshold voltage compensating operation may be performed in the sub-pixels included in the odd-numbered pixel group of the (k)th pixel row. However, the data voltage may be changed in synchronization with the first and second clock signals CLA and CLB, and then the connection of the corresponding data line may be also switched. Therefore, in the odd-numbered pixel group of the (k)th pixel row, the threshold voltage compensation may be performed by applying the data voltage VDATA during the first compensation period PA, and then the threshold voltage compensating operation may be maintained by the voltage of the floating data line during the second compensation period PB On the other hand, the (k)th even-numbered group gate signal GW_B(k) may corresponding to the activation level during the second compensation period PB and a third compensation period PC. Thus, the (k)th odd-numbered group gate signal GW_A(k) may overlap a part of the (k)th even-numbered group gate signal GW_B(k). In one example embodiment, the (k)th even-numbered group gate signal GW_B(k) may be delayed by ½ horizontal period from the (k)th odd-numbered group gate signal GW_A(k).

Therefore, during the second compensation period PB, the odd-numbered pixel group of the (k)th pixel row may maintain the compensating operation of the threshold voltage. At the same time, during the second compensation period PB, the even-numbered pixel group of the (k)th pixel row may perform the compensating operation of the threshold voltage by applying the data voltage VDATA to the sub-pixel.

During the third compensation period PC, the even-numbered pixel group of the (k)th pixel row may maintain the compensating operation of the threshold voltage by the voltage of the floating data line. At the same time, during the third compensation period PC, the (k+1)th odd-numbered group gate signal GW_A(k+1) of the (k+1)th pixel row may correspond to the activation level. Therefore, the odd-numbered pixel group of the (k+1)th pixel row may perform the compensating operation of the threshold voltage by applying the data voltage VDATA to the sub-pixel during the third compensation period PC.

In a similar manner, during a fourth compensation period PD, the odd-numbered pixel group of the (k+1)th pixel row may maintain the compensating operation of the threshold voltage by the voltage of the floating data line, and the even-numbered pixel group of the (k+1)th pixel row may perform the compensating operation of the threshold voltage by applying the data voltage VDATA.

After the fourth compensation period PD, the (k)th emission control signal EM(k) corresponding to the activation level may be commonly applied to entire sub-pixels in the (k)th pixel row. Therefore, entire sub-pixels in the (k)th pixel row may simultaneously emit light.

As described above, the odd-numbered group gate signal and the even-numbered group gate signal are partially overlapped such that the odd-numbered pixel group and the even-numbered pixel group perform different compensating operations at the same time. Further, because two types of compensating operations are performed for each sub-pixel, the time for compensating the threshold voltage may be sufficiently secured.

Figure 6:
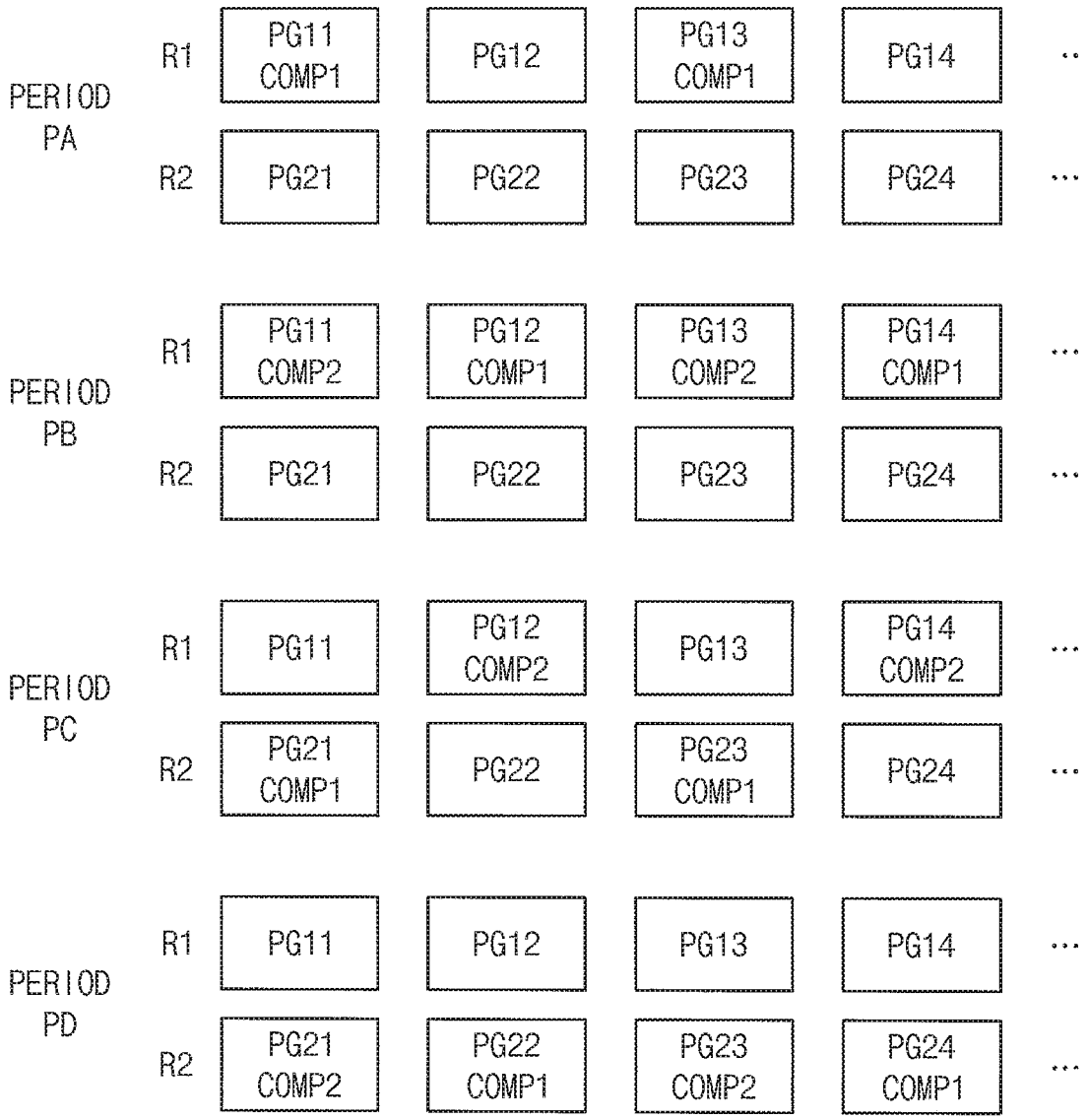
FIG. 6 is a diagram for describing operations of pixel groups in the compensation period according to the timing diagram of FIG. 5.

FIG. 6 is a diagram for describing operations of pixel groups in the compensation period according to the timing diagram of FIG. 5.

Referring to FIGS. 5 and 6, the threshold voltage compensating operation for the (k)th pixel row (e.g., the first pixel row R1) may be performed during the first to third compensation periods PA1, PA2 and PA3. The threshold voltage compensating operation for the (k+1)th pixel row (e.g., the second pixel row R2) may be performed during the second to fourth compensation periods PA2, PA3 and PA4.

During the first compensation period PA, the odd-numbered pixel groups PG11, PG13, . . . of the first pixel row R1 may perform a first compensating operation COMP1. Here, the first compensating operation COMP1 represents an operation of compensating the threshold voltage by applying the data voltage to the driving transistor TD in which the diode-connection is formed.

During the second compensation period PB, the odd-numbered pixel groups PG11, PG13, . . . of the first pixel row R1 may perform a second compensating operation COMP2. Here, the second compensating operation COMP2 represents an operation of maintaining the threshold voltage compensating operation by a voltage remaining (or stored) in the floating data line. At the same time, the even-numbered pixel groups PG12, PG14, . . . of the first pixel row R1 may perform the first compensating operation COMP1.

During the third compensation period PC, the even-numbered pixel groups PG12, PG14, . . . of the first pixel row R1 may perform the second compensating operation COMP2. At the same time, during the third compensation period PC, the odd-numbered pixel groups PG21, PG23, . . . of the second pixel row R2 may perform the first compensating operation COMP1.

During the fourth compensation period PD, the odd-numbered pixel groups PG21, PG23, . . . of the first pixel row R2 may perform the second compensating operation COMP2. At the same time, during the fourth compensation period PD, the even-numbered pixel groups PG22, PG24, . . . of the second pixel row R2 may perform the first compensating operation COMP1.

In a similar manner, the compensating operation may be sequentially performed until the last pixel row. Therefore, time for compensating the threshold voltage of the driving transistor may be sufficiently secured, and the display quality can be improved.

Figure 7:
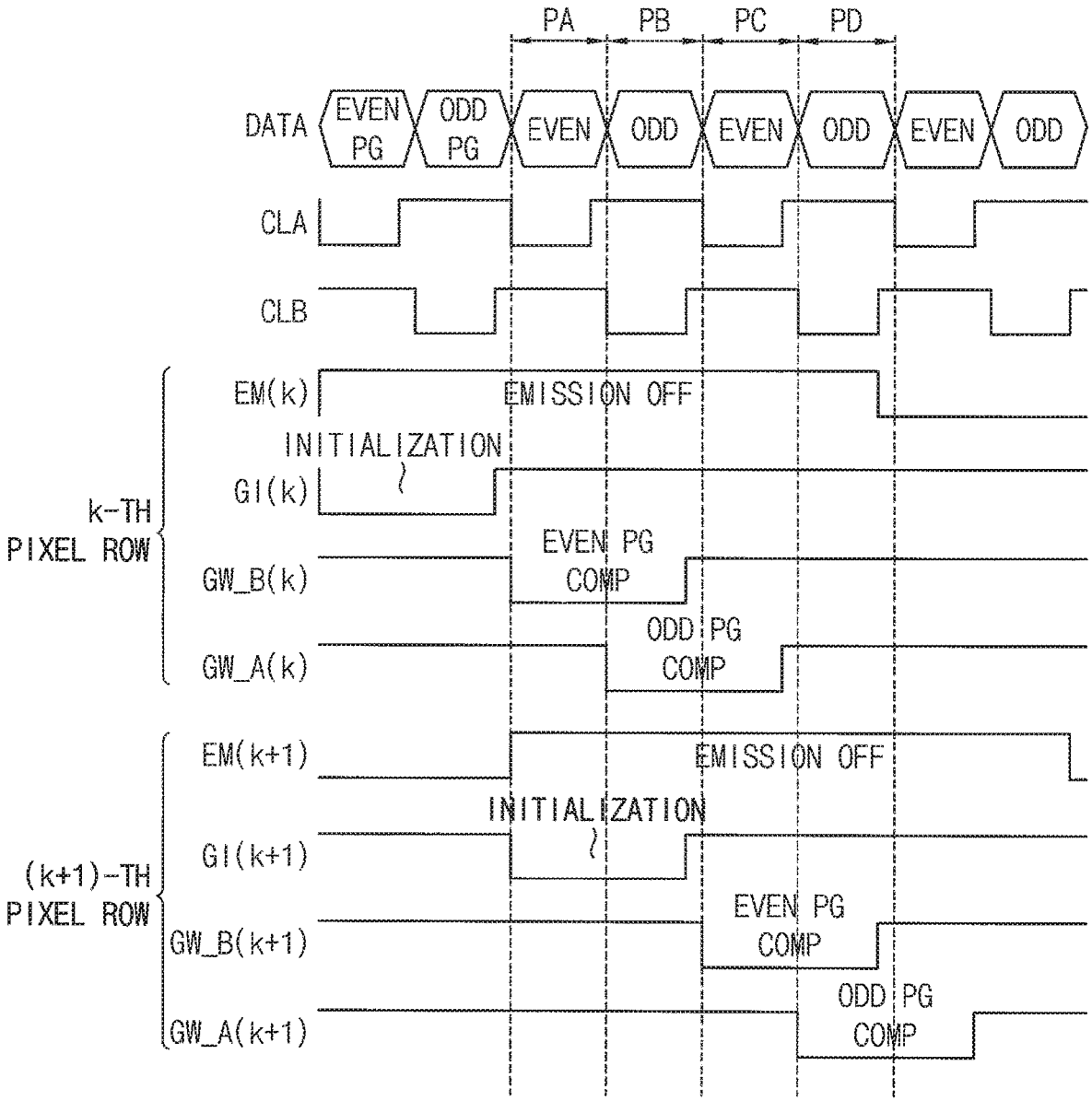
FIG. 7 is a timing diagram illustrating another example of signals for driving the display panel of FIG. 2.

FIG. 7 is a timing diagram illustrating another example of signals for driving the display panel of FIG. 2.

A method of driving the display panel according to the present exemplary embodiment is substantially the same as the method of driving the display panel of the exemplary embodiment described in FIGS. 5 and 6, except that the order of providing the even-numbered group gate signal and the odd-numbered group gate signal. Therefore, the same reference numerals will be used to refer to the same or like parts as those described in the previous exemplary embodiment of FIGS. 5 and 6, and any repetitive explanation concerning the above elements will be omitted.

Referring to FIG. 7, the threshold voltage compensation for the even-numbered pixel group may be performed prior to the threshold voltage compensation for the odd-numbered pixel group in each pixel row.

During the first compensation period PA, the even-numbered pixel group of the (k)th pixel row may perform the threshold voltage compensating operation (i.e., the first compensating operation) based on the data voltage VDATA by the (k)th even-numbered group gate signal GW_B(k).

During the second compensation period PB, the even-numbered pixel group of the (k)th pixel row may perform the threshold voltage compensating operation (i.e., the second compensating operation) based on the voltage of the floating data line by the (k)th even-numbered group gate signal GW_B(k). At the same time, during the second compensation period PB, the odd-numbered pixel group of the (k)th pixel row may perform the threshold voltage compensating operation (i.e., the first compensating operation) based on the data voltage VDATA by the (k)th odd-numbered group gate signal GW_A(k).

During the third compensation period PC, the odd-numbered pixel group of the (k)th pixel row may perform the threshold voltage compensating operation (i.e., the second compensating operation) based on the voltage of the floating data line by the (k)th odd-numbered group gate signal GW_A(k). At the same time, during the third compensation period PC, the even-numbered pixel group of the (k+1)th pixel row may perform the threshold voltage compensating operation (i.e., the first compensating operation) based on the data voltage VDATA by the (k+1)th even-numbered group gate signal GW_B(k+1).

During the fourth compensation period PD, a compensating operation for the (k+1)th pixel row may be performed in a similar manner to the compensating operation for the (k)th pixel row performed in the second compensation period PB.

Accordingly, time for compensating the threshold voltage of the organic light emitting display device may be sufficiently secured. However, the manner of distinguishing the pixel groups and the order of providing the gate signal are not limited thereto.

Figure 8:
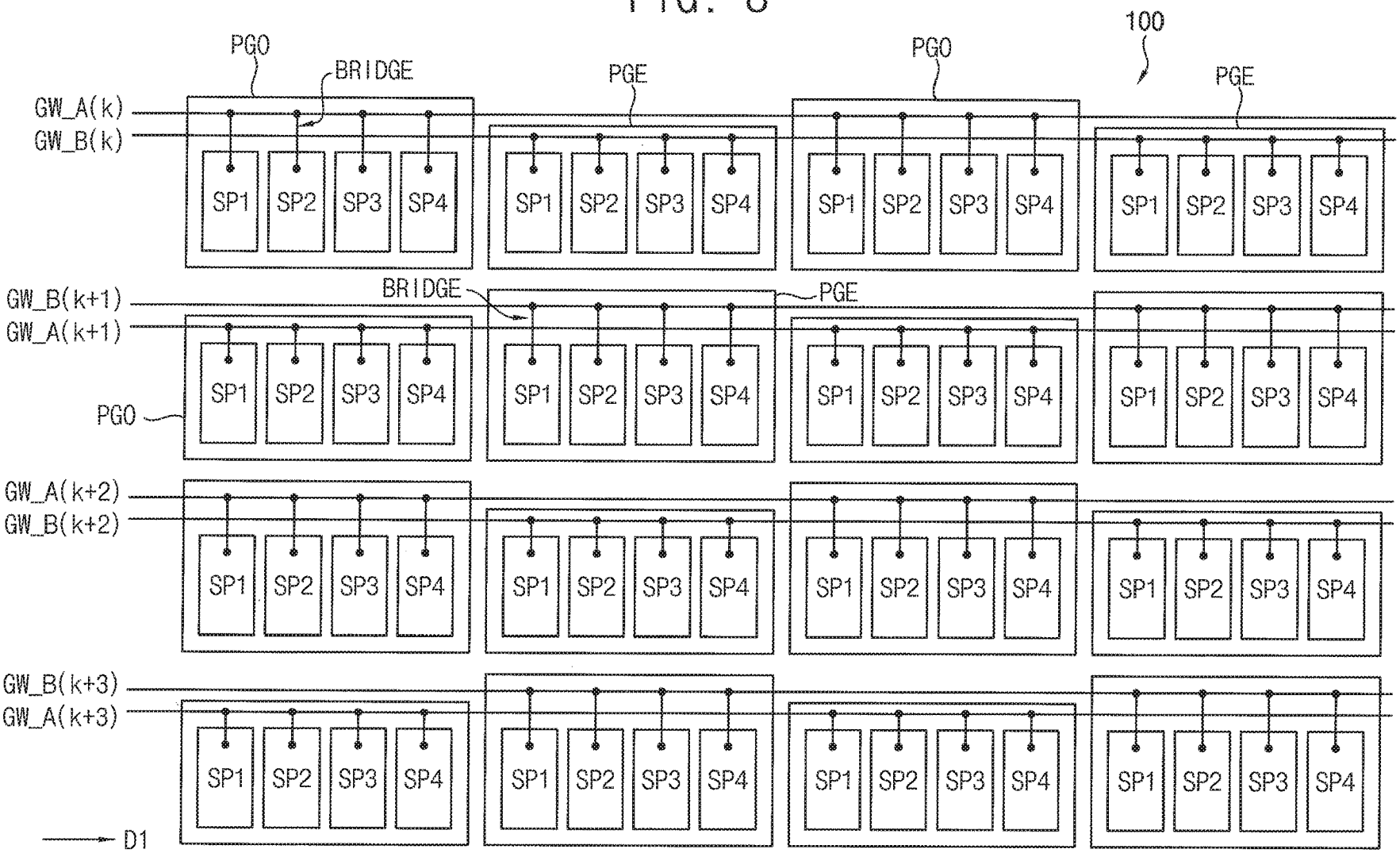
FIG. 8 is a diagram illustrating an example of an arrangement in which first group gate lines and second group gate lines are connected to pixel groups in the display panel of FIG. 2.
Figure 9:
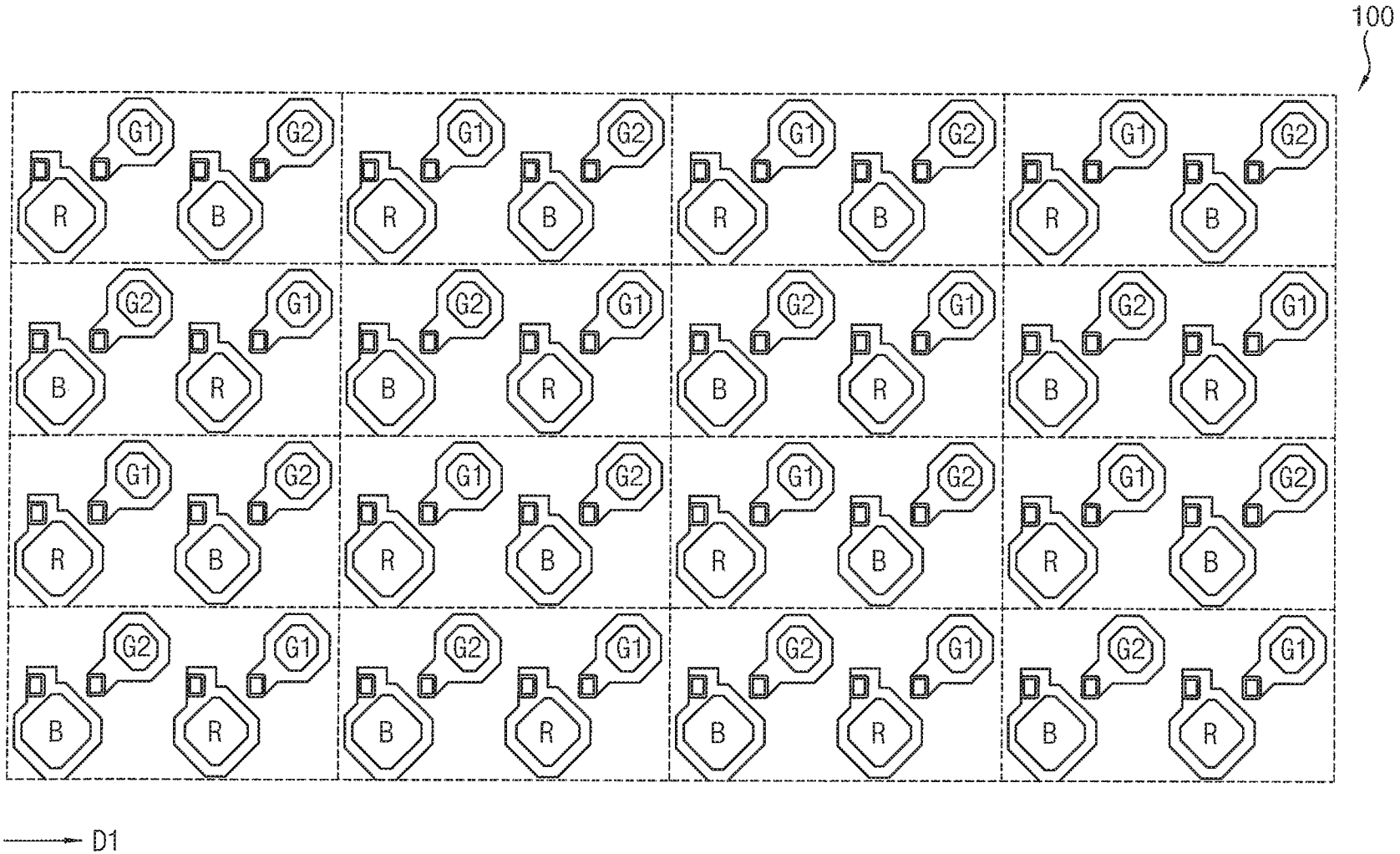
FIG. 9 is a diagram schematically illustrating an example of pixel groups included in the display panel of FIG. 2.

FIG. 8 is a diagram illustrating an example of an arrangement in which first group gate lines and second group gate lines are connected to pixel groups in the display panel of FIG. 2. FIG. 9 is a diagram schematically illustrating an example of pixel groups included in the display panel of FIG. 2.

Referring to FIGS. 2, 3, 8, and 9, the first group gate lines may be connected to the first pixel groups in each pixel row respectively, and the second group gate lines may be connected to the second pixel groups in each pixel row respectively. In one example embodiment, the first group gate lines may be odd-numbered group gate lines GW_A(k) to GW_A (k+3). The first pixel groups may be odd-numbered pixel groups PGO. The second group gate lines may be even-numbered group gate lines GW_B(k) to GW_B(k+3). The second pixel groups may be even-numbered pixel groups PGE.

The odd-numbered group gate lines GW_A(k) to GW_A (k+3) and the even-numbered group gate lines GW_B(k) to GW_B(k+3) may be extended in a first direction in which the pixel rows extend. In one example embodiment, the (k)th odd-numbered group gate line GW_A(k) for providing the (k)th odd-numbered group gate signal to the (k)th pixel row may be disposed farther from the first and second transistors of the sub-pixels included in the (k)th pixel row than the (k)th even-numbered group gate line GW_B(k) for providing the (k)th even-numbered group gate signal to the (k)th pixel row. As shown in FIG. 8, the (k)th odd-numbered group gate line GW_A(k) may be disposed farther from the sub-pixels of the (k)th pixel row than the (k)th even-numbered group gate line GW_B(k). Here, the first and second transistors in the sub-pixel are switch transistors connected to the (k)th odd-numbered group gate line GW_A (k) or the (k)th even-numbered group gate line GW_B(k). The (k)th odd-numbered group gate line GW_A (k) may be connected to the gate electrodes of the first and second transistors by a bridge structure.

In the (k+1)th pixel row adjacent to the (k)th pixel row, the gate lines may be arranged in a connection structure opposite to the (k)th pixel row. In one example embodiment, the (k+1)th even-numbered group gate line GW_B(k+1) may be disposed farther from the first and second transistors of the sub-pixels included in the (k+1)th pixel row than the (k+1)th odd-numbered group gate line GW_A(k+1). As shown in FIG. 8, the (k+1)th even-numbered group gate line GW_B(k+1) may be disposed farther from the sub-pixels included in the (k+1)th pixel row than the (k+1)th odd-numbered group gate line GW_A(k+1). The (k+1)th even-numbered group gate line GW_B(k+1) may be connected to the first and second transistors by the bridge structure.

In the (k)th pixel row, the odd-numbered pixel group PGO may be connected to the gate line disposed on the farther side from the pixel group through the bridge structure. Here, the bridge structure electrically separates the odd-numbered group gate line and the even-numbered group gate line at a crossing point of the gate lines using an insulating material disposed at the crossing point. In the (k+1)th pixel row, the odd-numbered pixel group PGO may be connected to the gate line disposed on the near side from the pixel group. On the other hand, in the (k)th pixel row, the even-numbered pixel group PGE may be connected to the gate line disposed on the near side from the pixel group. In the (k+1)th pixel row, the even-numbered pixel group PGE may be connected to the gate line disposed on the farther side from the pixel group through the bridge structure.

Therefore, even if a variation due to the resistance difference between the odd-numbered group gate lines GW_A (k) to GW_A(k+3) and the even-numbered group gate lines GW_B(k) to GW_B(k+3) occurs, the deviation not be recognized by user because the distance between the pixel groups PGO, PGE and the gate lines connected thereto are changed according to the pixel rows.

As shown in FIG. 9, the display panel 100 may include a plurality of odd pixel groups PGO and a plurality of even pixel groups PGE. In one embodiment, each of the odd pixel groups PGO and the even pixel groups PGE may include four sub-pixels. For example, each of the odd-numbered pixel groups PGO and the plurality of even-numbered pixel groups PGE may include a red color sub-pixel R, a blue color sub-pixel B, a first green color sub-pixel G1, and a second green color sub-pixel G2 in a first direction D1 in which pixel rows extend. When the sub-pixels described in FIG. 9 may be connected to one of the odd-numbered group gate lines or the even-numbered group gate lines described in FIG. 8, the resistance variation is uniformly dispersed. Accordingly, the luminance deviation may be not recognized.

Figure 10:
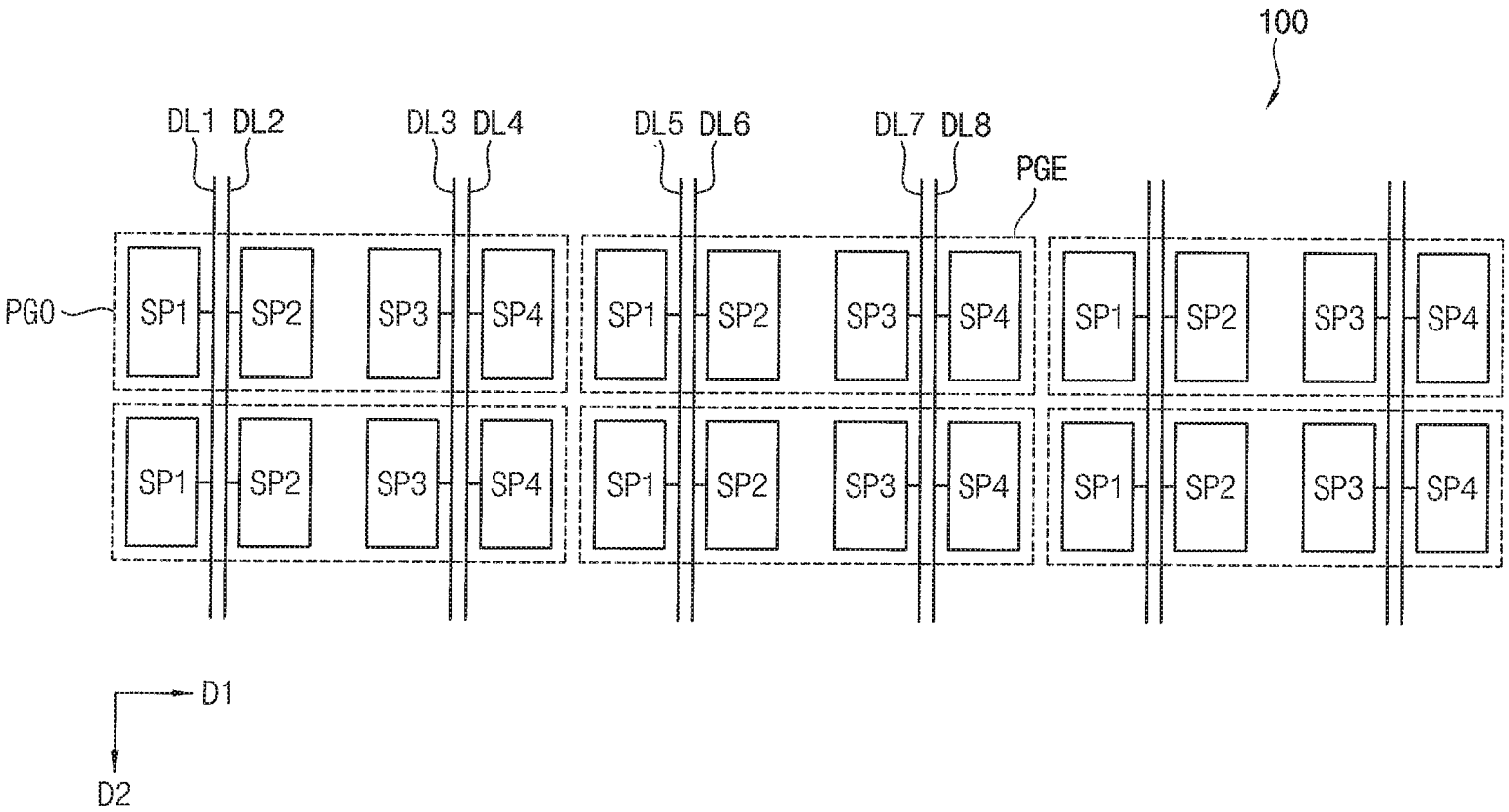
FIG. 10 is a diagram schematically illustrating an example of data lines connected to the display panel of FIG. 2.
Figure 11:
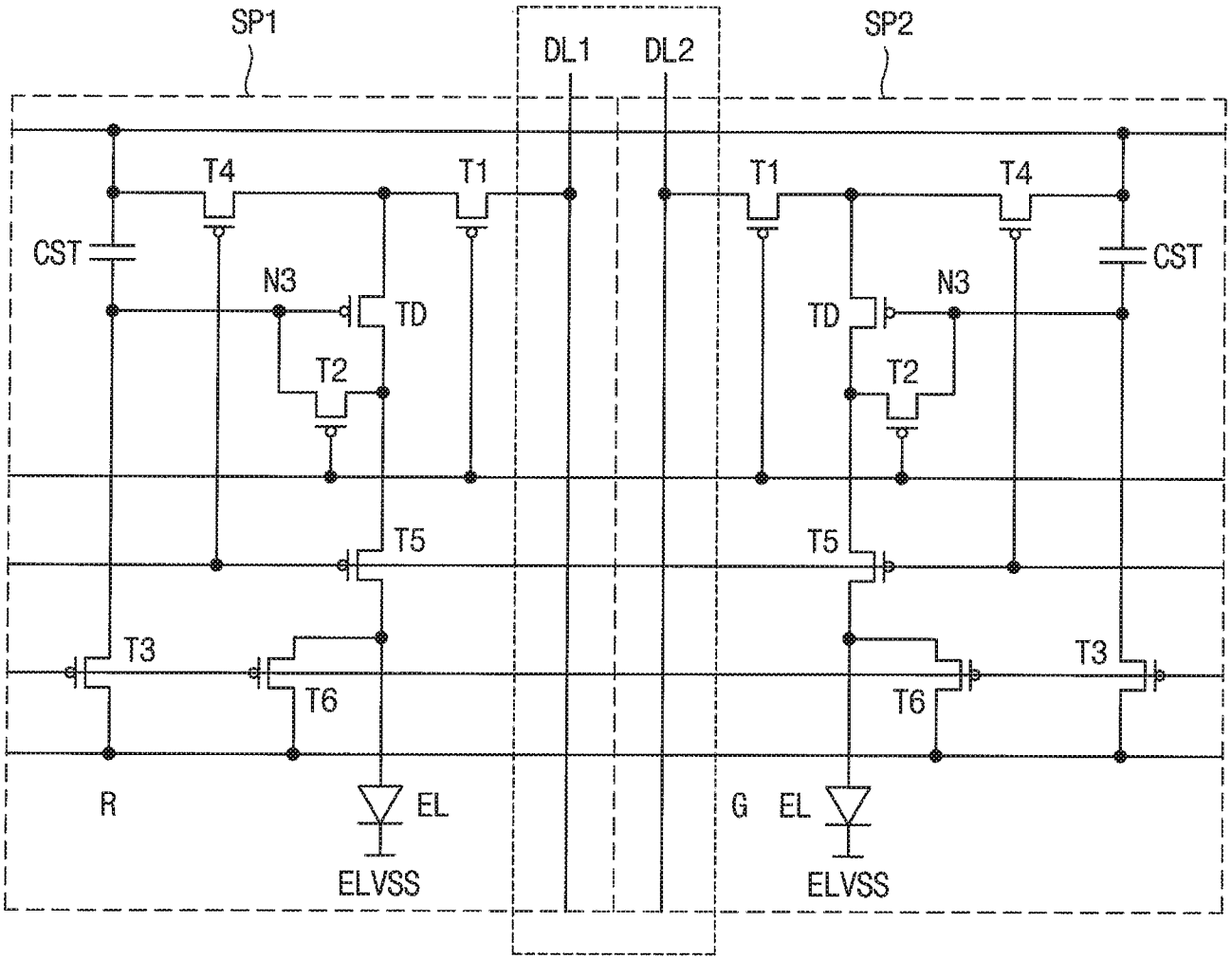
FIG. 11 is a circuit diagram illustrating an example of an arrangement of the data lines of FIG. 10.

FIG. 10 is a diagram schematically illustrating an example of data lines connected to the display panel of FIG. 2. FIG. 11 is a circuit diagram illustrating an example of an arrangement of the data lines of FIG. 10.

Referring to FIGS. 2, 10, and 11, each of the odd-numbered pixel groups PGO and the even-numbered pixel groups PGE may include four sub-pixels.

Each of the odd-numbered pixel groups PGO and the even-numbered pixel groups PGE may include a first sub-pixel SP1, a second sub-pixel SP2, a third sub-pixel SP3, and a fourth sub-pixel SP4. In one example embodiment, each of the first to fourth sub-pixels SP1 to SP4 may emit one of red color light, blue color light, and green color light. For example, the sub-pixels of the display panel 100 may be arranged in a pentile matrix structure shown in FIG. 9. For example, the first sub-pixel SP1 may emit different color light depending on the pixel row and/or pixel groups included therein.

In each of the odd-numbered pixel groups PGO and the even-numbered pixel groups PGE, the first data line DL1 connected to the first sub-pixel SP1 and the second data line DL2 connected to the second sub-pixel SP2 may extend in a second direction D2 in which pixel columns extend. The first data line DL1 and the second data line DL2 may be disposed between the first sub-pixel SP1 and the second sub-pixel SP2.

The third data line DL3 connected to the third sub-pixel SP3 and the fourth data line DL4 connected to the fourth sub-pixel SP4 may extend in the second direction D2, and may be disposed between the third sub-pixel SP3 and the fourth sub-pixel SP4. Further, no data line may be disposed between the second sub-pixel SP2 and the third sub-pixel SP3 and between the odd-numbered pixel group PGO and the even-numbered pixel group PGE.

As shown in FIG. 11, the data lines DL1 and DL2 connected to the two adjacent sub-pixels SP1 and SP2 respectively may be disposed between the sub-pixels SP1 and SP2. Adjacent sub-pixels (e.g., the first sub-pixel SP1 and the second sub-pixel SP2) may have structures symmetrical in the second direction D2 to form the connection with the data lines DL1 and DL2. In addition, the second sub-pixel SP2 and the third sub-pixel SP3 between which the data lines are not arranged may also have symmetrical structures.

Therefore, in the organic light emitting display device 1000 driven in DEMUX driving manner, the coupling effect due to switching data lines can be reduced by the symmetrical structures of sub-pixels and arrangement of the data lines.

Figure 12:
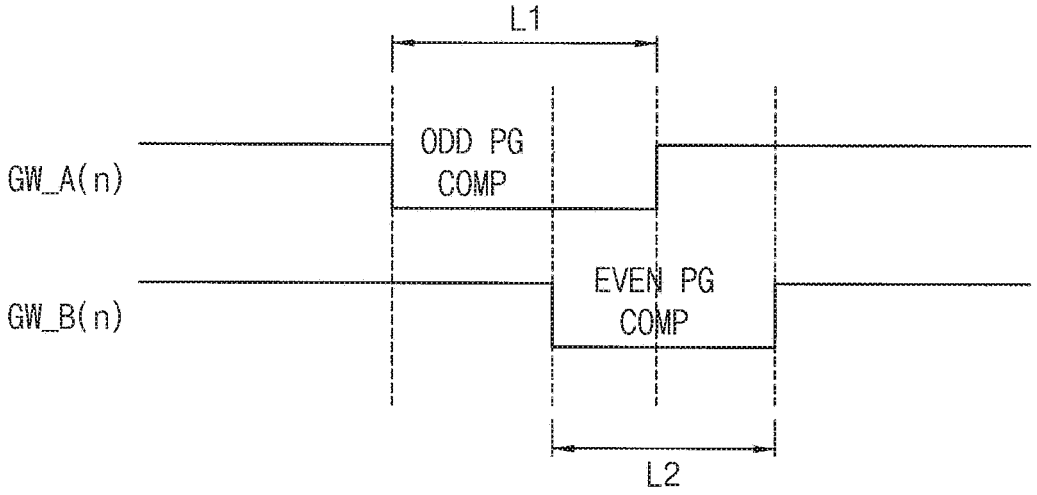
FIG. 12 is a diagram illustrating an example of a first group gate signal and a second group gate signal generated by the organic light emitting display device of FIG. 1.

FIG. 12 is a diagram illustrating an example of a first group gate signal and a second group gate signal generated by the organic light emitting display device of FIG. 1.

Referring to FIGS. 5 and 12, each of the sub-pixels may perform the above-described two types of threshold voltage compensating operations (i.e., the first compensating operation and the second compensating operation) based on the first group gate signal (e.g., the odd-numbered group gate signal) or the second group gate signal (e.g., the even-numbered group gate signal) to sufficiently secure the time for compensating the threshold voltage.

In one example embodiment, a length L1 of the activation period of the first group gate signal (or odd-numbered group gate signal GW_A(n)) may be different from a length L2 of the activation period of the second group gate signal (or even-numbered group gate signal GW_B(n)). For example, the odd-numbered group gate signal GW_A(n) and the even-numbered group gate signal GW_B(n) may be output from different gate drivers. Thus, the length L1 of the activation period of the odd-numbered group gate signal GW_A(n) and the length L2 of the activation period of the even-numbered group gate signal GW_B(n) may be different from each other by providing clock signals having different widths to the gate drivers respectively. For example, the length L1 of the activation period of the odd-numbered group gate signal GW_A(n) may be longer than the length L2 of the activation period of the even-numbered group gate signal GW_B(n). In contrast, the length L1 of the activation period of the odd-numbered group gate signal GW_A(n) may be shorter than the length L2 of the activation period of the even-numbered group gate signal GW_B(n).

Two gate lines (i.e., the odd-numbered group gate line and the even-numbered group gate line) may be apart from one pixel row at different distances. Accordingly, there is a possibility that a delay of the gate signal due to the resistance difference between the odd-numbered group gate line and the even-numbered group gate line occurs. To prevent the delay of the gate signal, the length L1 of the activation period of the odd-numbered group gate signal GW_A(n) and the length L2 of the activation period of the even-numbered group gate signal GW_B (n) may be set differently.

Therefore, the threshold voltage compensation time for the odd-numbered pixel group and the threshold voltage compensation time for the even-numbered pixel group can be separated from each other. The delay of the gate signal due to the resistance difference between the odd-numbered group gate line and the even-numbered group gate line can be reduced and the image quality can be improved.

Figure 13:
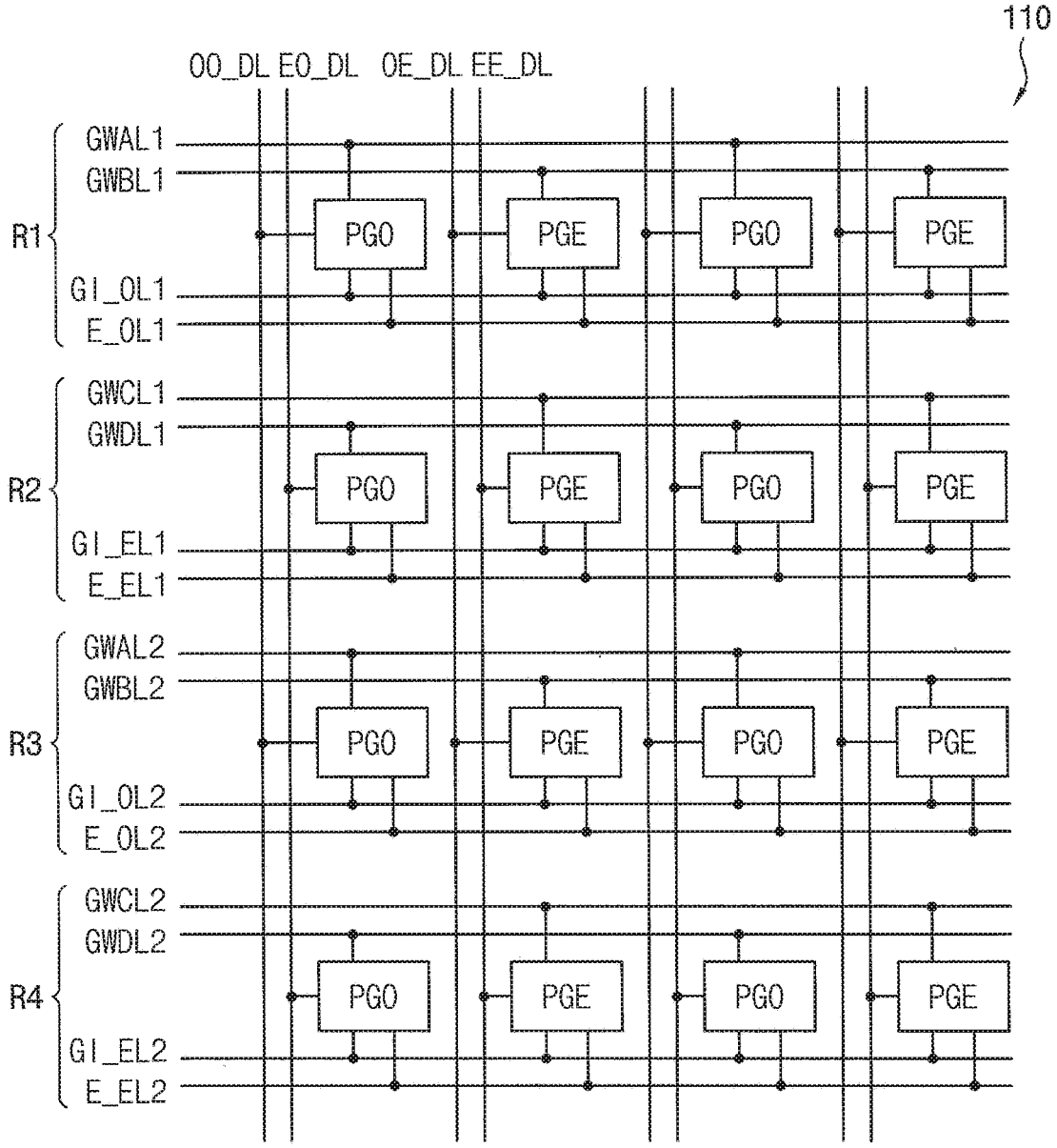
FIG. 13 is a diagram schematically illustrating a display panel included in the organic light emitting display device according to example embodiments.
Figure 14:
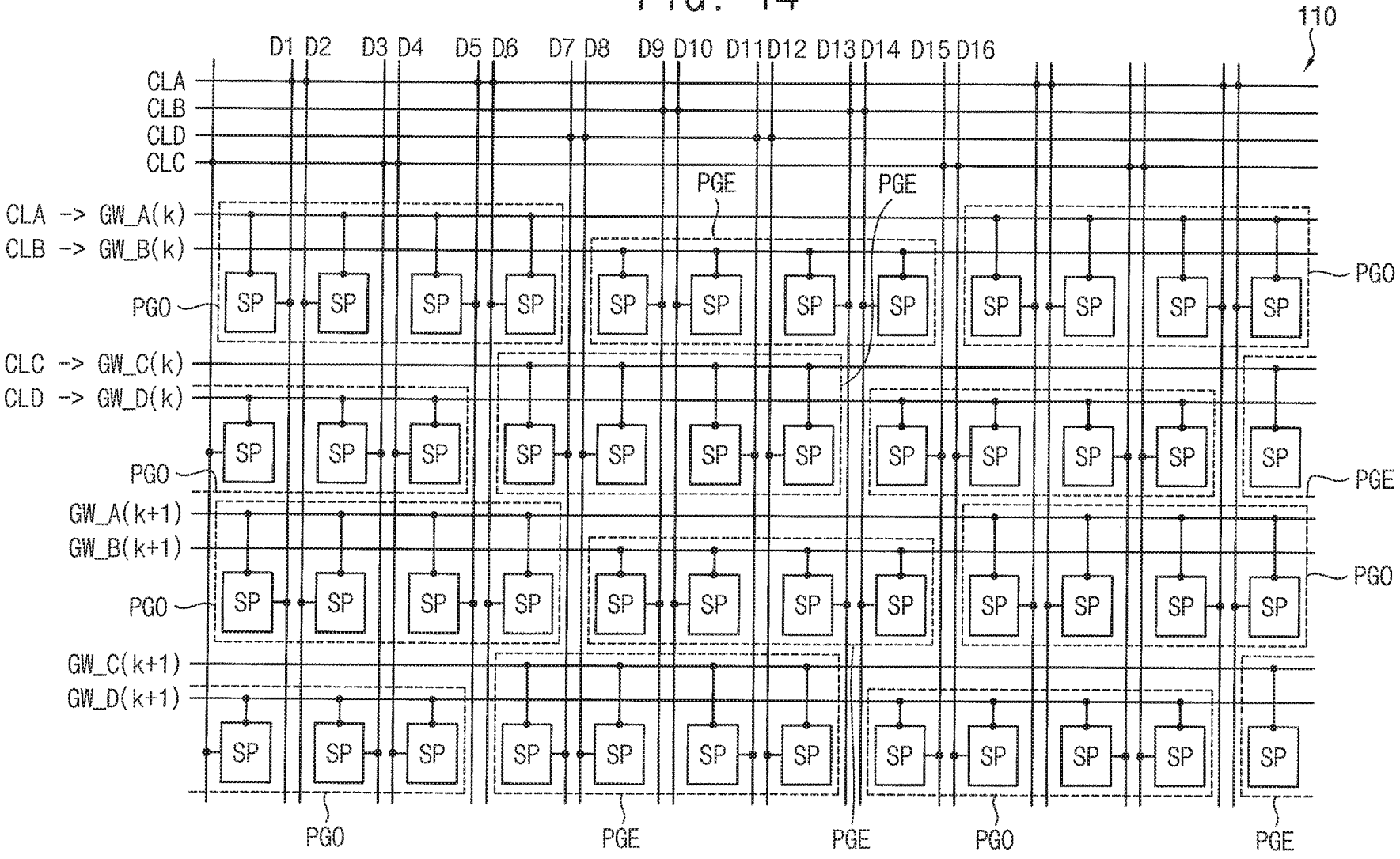
FIG. 14 is a diagram schematically illustrating an example of gate signals and data signals provided to the display panel of FIG. 13.

FIG. 13 is a diagram schematically illustrating a display panel 110 included in the organic light emitting display device according to example embodiments. FIG. 14 is a diagram schematically illustrating an example of gate signals and data signals provided to the display panel 110 of FIG. 13.

The organic light emitting display device according to present example embodiment is substantially the same as the organic light emitting display device of the example embodiment described in FIG. 1, except that odd-numbered pixel rows and even-numbered pixel rows are individually driven and the number of the data line increases twice compared to the organic light emitting display device of FIG. 1. Therefore, the same reference numerals will be used to refer to the same or like parts as those described in the previous exemplary embodiment of FIG. 1, and any repetitive explanation concerning the above elements will be omitted.

Referring to FIGS. 1, 13, and 14, the display panel 110 may include the odd-numbered pixel group PGO and the even-numbered pixel group PGE each including a plurality of sub-pixels. The organic light emitting display device may drive the display panel 110 in a DEMUX driving manner in which odd-numbered pixel rows and even-numbered pixel rows are driven individually.

The organic light emitting display device may include the display panel 110, a gate driver, a data driver, a data divider, and a timing controller. The operations of the gate driver, the data driver, the data divider, and the timing controller are substantially the same as those of FIG. 1 except for the operation timing. Therefore, duplicated descriptions will be omitted.

In one example embodiment, the pixel rows of the display panel 110 may be divided into first pixel rows and second pixel rows. For example, the first pixel row may be the odd-numbered pixel row, and the second pixel row may be the even-numbered pixel row next to the first pixel row. Also, a first initialization signal and a first emission control signal may be an odd-numbered initialization signal and an odd-numbered emission control signal provided to the first pixel row. Likewise, a second initialization signal and a second emission control signal may be an even-numbered initialization signal and an even-numbered emission control signal provided on the second pixel row.

Hereinafter, it is assumed that the pixel rows are divided into odd-numbered pixel rows and even-numbered rows to drive the display panel. However, the method of classifying the first pixel row and the second pixel row is not limited thereto.

The odd-numbered pixel rows R1, R3, . . . of the display panel 110 may be connected to the odd-numbered initialization lines GI_OL1, GI_OL2, . . . and odd-numbered emission control lines E_OL1, E_OL2, . . . . The even-numbered pixel rows R2, R4, . . . may be connected to the even-numbered initialization lines GI_EL1, GI_EL2, . . . and even-numbered emission control lines E_EL1, E_EL2, . . . . In addition, the number of data lines in the display device according to the present example embodiment increases twice compared to the organic light emitting display device of FIG. 1.

The odd-numbered initialization signal may be sequentially provided to the odd-numbered pixel rows R1, R3, . . . through the odd-numbered initialization lines GI_OL1, GI_OL2, . . . . The even-numbered initialization signal may be sequentially provided to the even-numbered pixel rows R2, R4, . . . through the even-numbered initialization lines GI_EL1, GI_EL2, . . . . The initialization signals provided to adjacent pixel rows may have an interval of approximately one horizontal period.

The odd-numbered emission control signal may be sequentially provided to the odd-numbered pixel rows R1, R3, . . . through the odd-numbered emission control lines E_OL1, E_OL2, . . . . The even-numbered emission control signal may be sequentially provided to the even-numbered pixel rows R2, R4, . . . through the even-numbered emission control lines E_EL1, E_EL2, . . . . The emission control signals provided to adjacent pixel rows may have an interval of approximately one horizontal period.

Further, the first pixel groups PGO (hereinafter, the odd-numbered pixel group PGO) of the odd-numbered pixel rows R1, R3, . . . may be connected to the first group gate lines (hereinafter, <odd-numbered row, odd-numbered group> gate lines GWAL1, GWAL2). The second pixel groups PGE (hereinafter, the even-numbered pixel group PGE) of the odd-numbered pixel rows R1, R3, . . . may be connected to the second group gate lines (hereinafter, <odd-numbered row, even-numbered group> gate lines GWBL1, GWBL2).

Likewise, the third pixel groups PGO (hereinafter, the odd-numbered pixel group PGO) of the even-numbered pixel rows R2, R4, . . . may be connected to the third group gate lines (hereinafter, <even-numbered row, odd-numbered group> gate lines GWDL1, GWDL2). The fourth pixel groups PGE (hereinafter, the even-numbered pixel group PGE) of the even-numbered pixel rows R2, R4, . . . may be connected to the fourth group gate lines (hereinafter, <even-numbered row, even-numbered group> gate lines GWCL1, GWCL2).

The first group gate signal (hereinafter, <odd-numbered row, odd-numbered group> gate signal GW_A(k), GW_A (k+1)) may be sequentially provided to the odd-numbered pixel rows R1, R3, . . . through the <odd-numbered row, odd-numbered group> gate lines GWAL1, GWAL2, . . . according to the first clock signal CLA.

The second group gate signal (hereinafter, <odd-numbered row, even-numbered group> gate signal GW_B(k), GW_B(k+1)) may be sequentially provided to the odd-numbered pixel rows R1, R3, . . . through the <odd-numbered row, even-numbered group> gate lines GWBL1, GWBL2, . . . according to the second clock signal CLB. The second clock signal CLB may be delayed by a quarter period of the clock signal from the first clock signal CLA.

The fourth group gate signal (hereinafter, <even-numbered row, even-numbered group> gate signal GW_C(k), GW_C(k+1) may be sequentially provided to the even-numbered pixel rows R2, R4, . . . through the <even-numbered row, even-numbered group> gate lines GWCL1, GWCL2, . . . according to the third clock signal CLC. The third clock signal CLC may be delayed by a quarter period of the clock signal from the second clock signal CLB.

The third group gate signal (hereinafter, <even-numbered row, odd-numbered group> gate signal GW_D(k), GW_D (k+1)) may be sequentially provided to the even-numbered pixel rows R2, R4, . . . through the <even-numbered row, odd-numbered group> gate lines GWDL1, GWDL2, . . . according to the fourth clock signal CLD. The fourth clock signal CLD may be delayed by a quarter period of the clock signal from the third clock signal CLC.

The display panel 110 may include first group data lines, second group data lines, third group data lines, and fourth group data lines. The first group data lines (hereinafter, <odd-numbered row, odd-numbered group> data lines OO_DL) may be connected to the odd-numbered pixel groups PGO of the odd-numbered pixel rows R1, R3, . . . . The second group data lines (hereinafter, <odd-numbered row, even-numbered group> data lines OE_DL) may be connected to the even-numbered pixel groups PGE of the odd-numbered pixel rows R1, R3, . . . . The third group data lines (hereinafter, <even-numbered row, odd-numbered group> data lines EO_DL) may be connected to the odd-numbered pixel groups PGO of the even-numbered pixel rows R2, R4, . . . . The fourth group data lines (hereinafter, <even-numbered row, even-numbered group> data lines EE_DL) may be connected to the even-numbered pixel groups PGE of the even-numbered pixel rows R2, R4, . . . .

The <odd-numbered row, odd-numbered group> data lines OO_DL may include four data lines for each odd-numbered pixel group PGO. As shown in FIG. 14, the <odd-numbered row, odd-numbered group> data lines OO_DL may be for transferring data voltages D1, D2, D5, D6, etc. The <odd-numbered row, odd-numbered group> data lines OO_DL may provide the data voltages D1, D2, D5, D6, etc to the display panel 110 (i.e., sub-pixels in odd-numbered pixel group of the odd-numbered pixel row) based on the first clock signal CLA. At the same time, the <odd-numbered row, odd-numbered group> gate signals GW_A(k), GW_A(k+1), . . . may be applied to one of the odd-numbered pixel rows R1, R3, . . . . Accordingly, the odd-numbered pixel group PGO of the odd-numbered pixel row may perform the data writing and threshold voltage compensating operation.

The <odd-numbered row, even-numbered group> data lines OE_DL may include four data lines for each even-numbered pixel group PGE. As shown in FIG. 14, the <odd-numbered row, even-numbered group> data lines OE_DL may be for transferring data voltages D9, D10, D13, D14, etc. The <odd-numbered row, even-numbered group> data lines OE_DL may provide the data voltages D9, D10, D13, D14, etc to the display panel 110 (i.e., sub-pixels in even-numbered pixel group of the odd-numbered pixel row) based on the second clock signal CLB. At the same time, the <odd-numbered row, even-numbered group> gate signals GW_B(k), GW_B(k+1), . . . may be applied to one of the odd-numbered pixel rows R1, R3, . . . . Accordingly, the even-numbered pixel group PGE of the odd-numbered pixel row may perform the data writing and threshold voltage compensating operation.

The <even-numbered row, even-numbered group> data lines EE_DL may include four data lines for each even-numbered pixel group PGE. As shown in FIG. 14, the <even-numbered row, even-numbered group> data lines EE_DL may be for transferring data voltages D7, D8, D11, D12, etc. The <even-numbered row, even-numbered group> data lines EE_DL may provide the data voltages D7, D8, D11, D12, etc to the display panel 110 (i.e., sub-pixels in even-numbered pixel group of the even-numbered pixel row) based on the third clock signal CLC. At the same time, the <even-numbered row, even-numbered group> gate signals GW_C(k), GW_C(k+1), . . . may be applied to one of the even-numbered pixel rows R2, R4, . . . . Accordingly, the even-numbered pixel group PGE of the even-numbered pixel row may perform the data writing and threshold voltage compensating operation.

The <even-numbered row, odd-numbered group> data lines EO_DL may include four data lines for each odd-numbered pixel group PGO. As shown in FIG. 14, the <even-numbered row, odd-numbered group> data lines EO_DL may be for transferring data voltages D3, D4, D15, D16, etc. The <even-numbered row, odd-numbered group> data lines EO_DL may provide the data voltages D3, D4, D15, D16, etc to the display panel 110 (i.e., sub-pixels in odd-numbered pixel group of the even-numbered pixel row) based on the fourth clock signal CLD. At the same time, the <even-numbered row, odd-numbered group> gate signals GW_D(k), GW_D(k+1), . . . may be applied to one of the even-numbered pixel rows R2, R4, . . . . Accordingly, the odd-numbered pixel group PGO of the even-numbered pixel row may perform the data writing and threshold voltage compensating operation.

In summary, the data writing and threshold voltage compensating operation may be performed in an order of the odd-numbered pixel group of the (2k−1)th pixel row, the even-numbered pixel group of the (2k−1)th pixel row, the even-numbered pixel group of the (2k)th pixel row, and the odd-numbered pixel group of the (2k)th pixel row. In this way, when the display device is driven at high-frequency (e.g., 120 Hz), the compensation time can be ensured sufficiently (e.g., longer than two horizontal periods).

In one example embodiment, the (k)<odd-numbered row, odd-numbered group> gate line connected to the (2k−1)th pixel row may be disposed farther from the (2k−1)th pixel row than the (k)<odd-numbered row, even-numbered group> gate line and may be connected to each of the sub-pixels in the odd-numbered pixel group by a bridge structure. In addition, the (k) <even-numbered row, even-numbered group> gate line connected to the (2k)th pixel row may be disposed farther from the (2k)th pixel row than the (k)<even-numbered row, odd-numbered group> gate line and may be connected to each of the sub-pixels in the even-numbered pixel group by the bridge structure.

For example, as shown in FIGS. 13 and 14, the first <odd-numbered row, odd-numbered group> gate line GWAL1 may be disposed farther from the first pixel row R1 than the first <odd-numbered row, even-numbered group> gate line GWBL1. The first <odd-numbered row, odd-numbered group> gate line GWAL1 may be connected to each of the sub-pixels of the odd-numbered pixel group PGO by a bridge structure. Also, the first <even-numbered row, even-numbered group> gate line GWCL1 may be disposed farther from the second pixel row R2 than the first <even-numbered row, odd-numbered group> gate line GWDL1. The first <even-numbered row, even-numbered group> gate line GWCL1 may be connected to each of the sub-pixels of the even-numbered pixel group PGE by the bridge structure.

In contrast, in another example embodiment, the (k)th <odd-numbered row, even-numbered group> gate line connected to the (2k−1)th pixel row may be disposed farther from the (2k−1)th pixel row than the (k)th <odd-numbered row, odd-numbered group> gate line and may be connected to each of the sub-pixels in the even-numbered pixel group by the bridge structure. The (k)th <even-numbered row, odd-numbered group> gate line connected to the (2k)th pixel row may be disposed farther from the (2k)th pixel row than the (k)th <even-numbered row, even-numbered group> gate line and may be connected to each of the sub-pixels in the odd-numbered pixel group by the bridge structure.

Therefore, the light emitting deviations due to the resistance difference between the two-types of gate lines corresponding to one pixel row may not be recognized.

Figure 15:
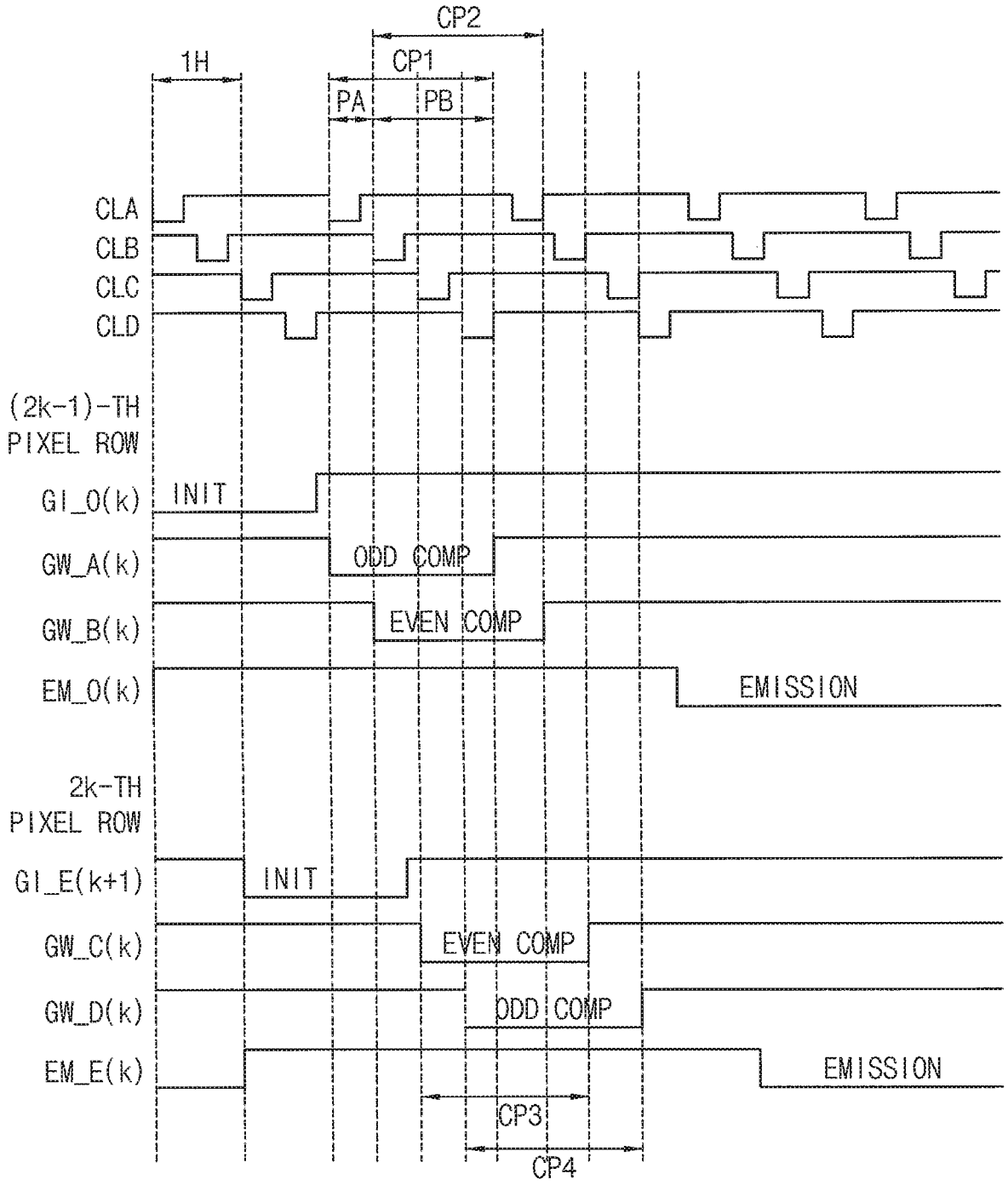
FIG. 15 is a timing diagram illustrating an example of signals for driving the display panel of FIG. 14.
Figure 16A:
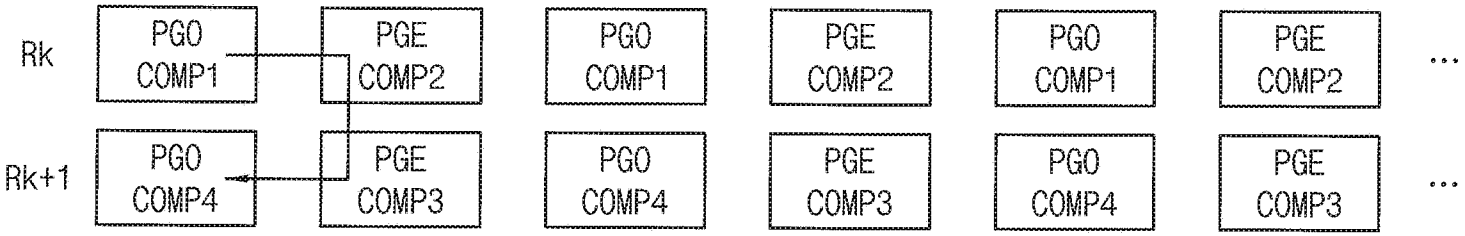
FIG. 16A is a diagram for describing an example in which a threshold voltage of a driving transistor is compensated in the display panel of FIG. 14.

FIG. 15 is a timing diagram illustrating an example of signals for driving the display panel of FIG. 14. FIG. 16A is a diagram for describing an example in which a threshold voltage of a driving transistor is compensated in the display panel of FIG. 14.

Referring to FIGS. 14 to 16A, the display panel 110 may be driven in a manner in which single frame period includes an initialization period INIT, a compensation period ODD COMP, EVEN COMP, and an emission period EMISSION.

The odd-numbered pixel rows and the even-numbered pixel rows may be driven independently.

In one example embodiment, the first to fourth clock signals CLA, CLB, CLC, and CLD may be sequentially activated in about ½ horizontal period intervals. Therefore, the (k)th <odd-numbered row, even-numbered group> gate signal GW_B(k) corresponding to the (2k−1)th pixel row may be delayed by about ½ the horizontal period from the (k)th <odd-numbered row, odd-numbered group> gate signal GW_A(k). The (k)th <even-numbered row, even-numbered group> gate signal GW_C(k) corresponding to the (2k)th pixel row may be delayed by about ½ the horizontal period from the (k)th <odd-numbered row, even-numbered group> gate signal GW_B(k). The (k)th <even-numbered row, odd-numbered group> gate signal GW_D(k) may be delayed by about ½ the horizontal period from the (k)th <even-numbered row, even-numbered group> gate signal GW_C(k).

The odd-numbered initialization signal GI_O(k) may be activated in synchronization with the first clock signal. The gate electrode of the driving transistor and the anode electrode of the organic light emitting diode in the (2k−1)th pixel row may be initialized simultaneously during the initialization period INIT.

Thereafter, the <odd-numbered row, odd-numbered group> GW_A(k) may be activated in synchronization with the first clock signal CLA, and then the data writing and threshold voltage compensating operation for the odd-numbered pixel group PGO of the (2k−1)th pixel row may be performed during the compensation period CP1. The compensation period CP1 may include a first compensation period PA and a second compensation period PB.

During the first compensation period PA, the <odd-numbered row, odd-numbered group> data line may transfer the data voltage to the driving transistor in the sub-pixel in which the diode-connection is formed such that the threshold voltage of the driving transistor is compensated (i.e., the first compensating operation). During the second compensation period PB, since the first clock signal CLA is deactivated, the <odd-numbered row, odd-numbered group> data line may be in a floating status. At this time, the threshold voltage compensating operation may be maintained based on the voltage of the floating <odd-numbered row, odd-numbered group> data line (i.e., the second compensating operation). Since the first and second compensating operations are described above with reference to FIGS. 5 and 6, duplicated descriptions will be omitted.

While the second compensating operation for odd-numbered pixel group PGO of the (2k−1)th pixel row is performed, the compensation period CP2 for the even-numbered pixel group PGE of the (2k−1)th pixel row may be performed based on the second clock signal CLB. Similar to the compensation period CP1, the first compensating operation and the second compensating operation may perform in the compensation period CP2 for the even-numbered pixel group PGE of the (2k−1)th pixel row.

The data writing and threshold voltage compensating operation for the even-numbered pixel group PGE of the (2k)th pixel row may be performed based on the third clock signal CLC. The compensation period CP3 for the even-numbered pixel group PGE of the (2k)th pixel row may be delayed by one horizontal period 1H from the compensation period CP1 for the odd-numbered pixel group PGO of the (2k−1) th pixel row. Similar to the compensation period CP1, the first compensating operation and the second compensating operation may perform in the compensation period CP3 for the even-numbered pixel group PGE of the (2k)th pixel row.

While the second compensating operation for even-numbered pixel group PGE of the (2k)th pixel row is performed, the compensation period CP4 for the odd-numbered pixel group PGO of the (2k)th pixel row may be proceeded based on the fourth clock signal CLD. Similar to the compensation period CP3, the first compensating operation and the second compensating operation may be performed in the compensation period CP4 for the odd-numbered pixel group PGO of the (2k)th pixel row.

Thereafter, entire sub-pixels of the (2k−1)th pixel row may emit light based on the (k)th odd-numbered emission control signal EM_O(k). Likewise, entire sub-pixels of the (2k)th pixel row may emit light based on the (k)th even-numbered emission control signal EM_E(k).

The data writing and compensating operation may be started by the first through fourth clock signals CLA, CLB, CLC, and CLD. For example, as shown in FIG. 15, the third clock signal may be for the even-number pixel group of the even-number pixel row. However, the order of the compensating operation is not limited thereto.

As shown in FIG. 16A, the data writing and compensating operation may be started sequentially. In the first place, the odd-numbered pixel group PGO of the (k)th pixel row Rk may start to perform the data writing and compensating operation (COMP1). In the second place, the even-numbered pixel group PGE of the (k)th pixel row Rk may start to perform the data writing and compensating operation (COMP2). In the third place, the even-numbered pixel group PGE of the (k+1)th pixel row Rk+1 may start to perform the data writing and compensating operation (COMP3). In the fourth place, the odd-numbered pixel group PGO of the (k+1)th pixel row Rk+1 may start to perform the data writing and compensating operation (COMP4). In addition, the compensation periods may be partially overlapped as shown in FIG. 15. However, the order of the data writing and threshold voltage compensating is not limited thereto.

As described above, the organic light emitting display device according to example embodiments separates the odd-numbered pixel group and the even-numbered pixel group and separates the odd-numbered pixel row and even-numbered pixel row to perform the compensating operation of the threshold voltage of the driving transistors in a partially overlapping manner. Accordingly, the compensation period may be sufficiently secured in the display device driven at high frequency above 120 Hz. For example, the threshold voltage compensation time is about 2.17 um in a conventional display device driven in DEMUX driving manner at 60 Hz. Further, the threshold voltage compensation time is about 1.08 um in a conventional display device driven in DEMUX driving manner at 120 Hz. However, the organic light emitting display device according to present example embodiment can secure the threshold voltage compensation time of more than 6.5 um (about 2 horizontal period) when the display device is driven at 120 Hz. Therefore, degradation of image quality such as stain caused when the high-resolution display device is driven at high-frequency can be prevented.

Figure 16B:
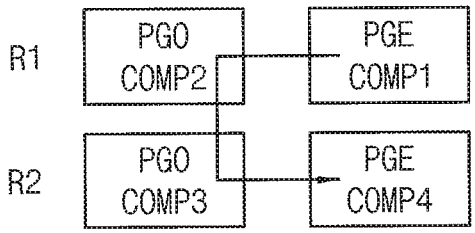
FIGS. 16B, 16C, and 16D are diagrams for describing examples in which a threshold voltage of a driving transistor is compensated in the display panel of FIG. 14.
Figure 16C:
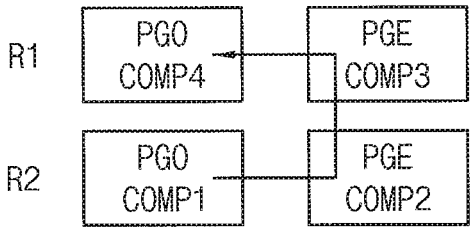
Figure 16D:
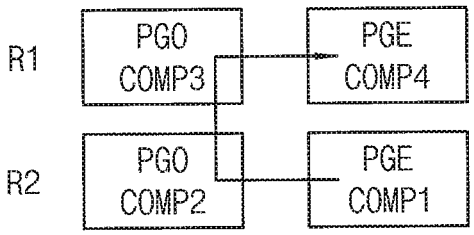

FIGS. 16B to 16D are diagrams for describing examples in which a threshold voltage of a driving transistor is compensated in the display panel of FIG. 14.

Referring to FIGS. 16B to 16D, the data writing and compensating operation for the even-numbered pixel group and the odd-numbered pixel group included in each pixel row may be controlled by the timing of the first to fourth clock signals.

In one example embodiment, the data writing and the threshold voltage compensating operation may be performed in an order of the even-numbered pixel group of the (2k−1)th pixel row, the odd-numbered pixel group of the (2k−1)th pixel row, the odd-numbered pixel group of the (2k)th pixel row, and the even-numbered pixel group of the (2k)th pixel row, where k is an integer greater than 0. For example, as shown in FIG. 16B, the data writing and threshold voltage compensating operation may be performed in the order of the even-number pixel group PGE of the first pixel row R1, the odd-number pixel group PGO of the first pixel row R1, the odd-numbered pixel group PGO of the second pixel row R2, and the even-numbered pixel group PGE of the second pixel row R2 (i.e., in the order of COMP1→COMP2→COMP3→COMP4, referring to FIG. 16B).

In one example embodiment, the data writing and the threshold voltage compensating operation may be performed in an order of the odd-numbered pixel group of the (2k)th pixel row, the even-numbered pixel group of the (2k)th pixel row, the even-numbered pixel group of the (2k−1)th pixel row, and the odd-numbered pixel group of the (2k−1)th pixel row, where k is an integer greater than 0. For example, as shown in FIG. 16C, the data writing and threshold voltage compensating operation may be performed in the order of the odd-number pixel group PGO of the second pixel row R2, the even-number pixel group PGE of the second pixel row R2, the even-numbered pixel group PGE of the first pixel row R1, and the odd-numbered pixel group PGO of the first pixel row R1 (i.e., in the order of COMP1→COMP2→COMP3→COMP4, referring to FIG. 16C).

In one example embodiment, the data writing and the threshold voltage compensating operation may be performed in an order of the even-numbered pixel group of the (2k)th pixel row, the odd-numbered pixel group of the (2k)th pixel row, the odd-numbered pixel group of the (2k−1)th pixel row, and the even-numbered pixel group of the (2k−1)th pixel row, where k is an integer greater than 0. For example, as shown in FIG. 16D, the data writing and threshold voltage compensating operation may be performed in the order of the even-number pixel group PGE of the second pixel row R2, the odd-number pixel group PGO of the second pixel row R2, the odd-numbered pixel group PGO of the first pixel row R1, and the even-numbered pixel group PGE of the first pixel row R1 (i.e., in the order of COMP1→COMP2→COMP3→COMP4, referring to FIG. 16D).

Figure 17:
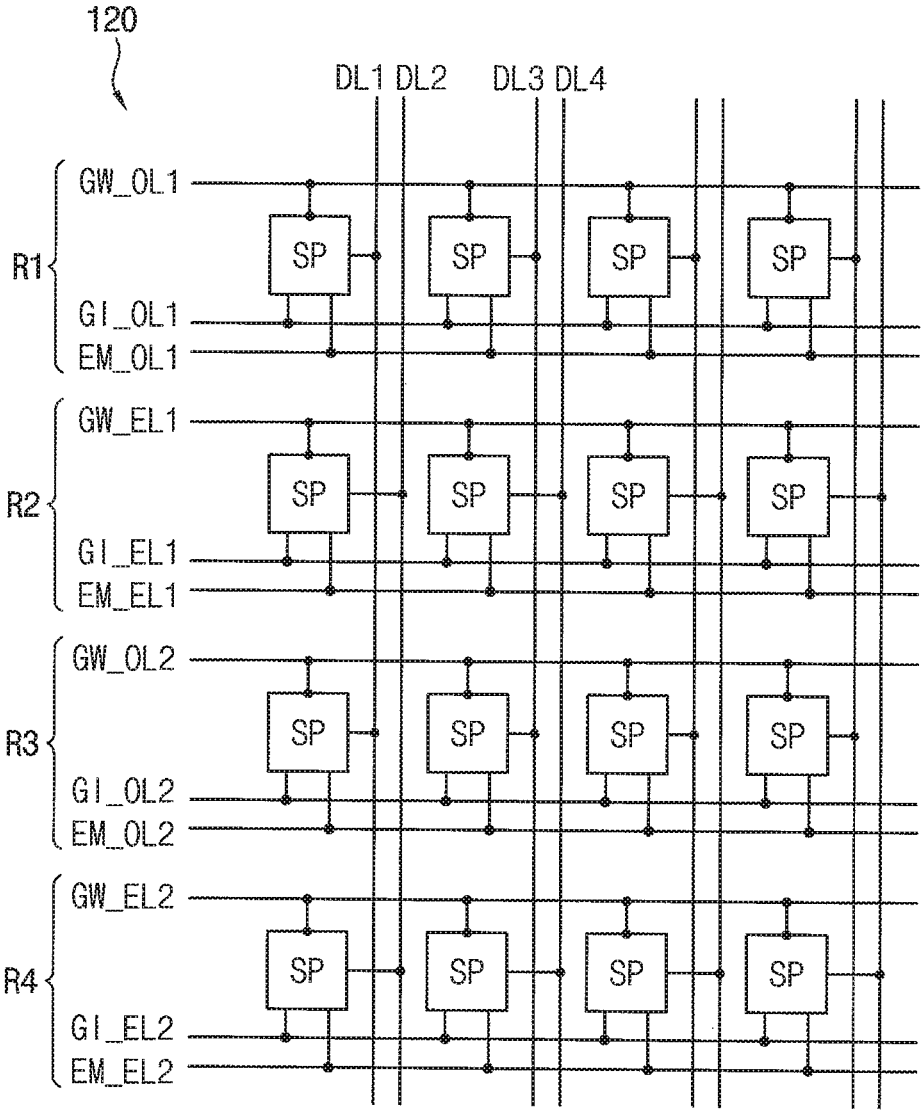
FIG. 17 is a block diagram illustrating an organic light emitting display device according to example embodiments.
Figure 18:
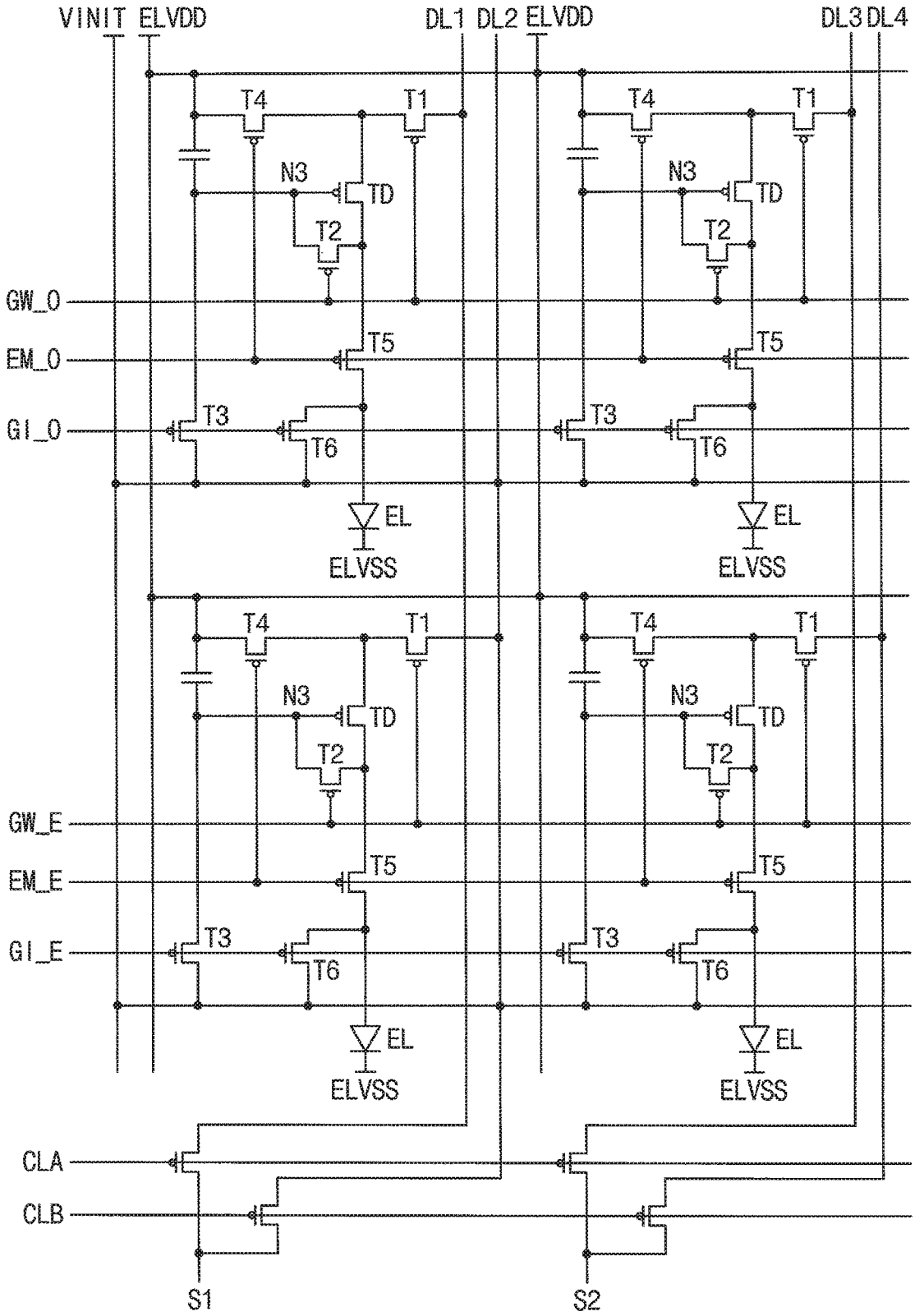
FIG. 18 is a diagram illustrating an example of a display panel included in the organic light emitting display device of FIG. 17.
Figure 19:
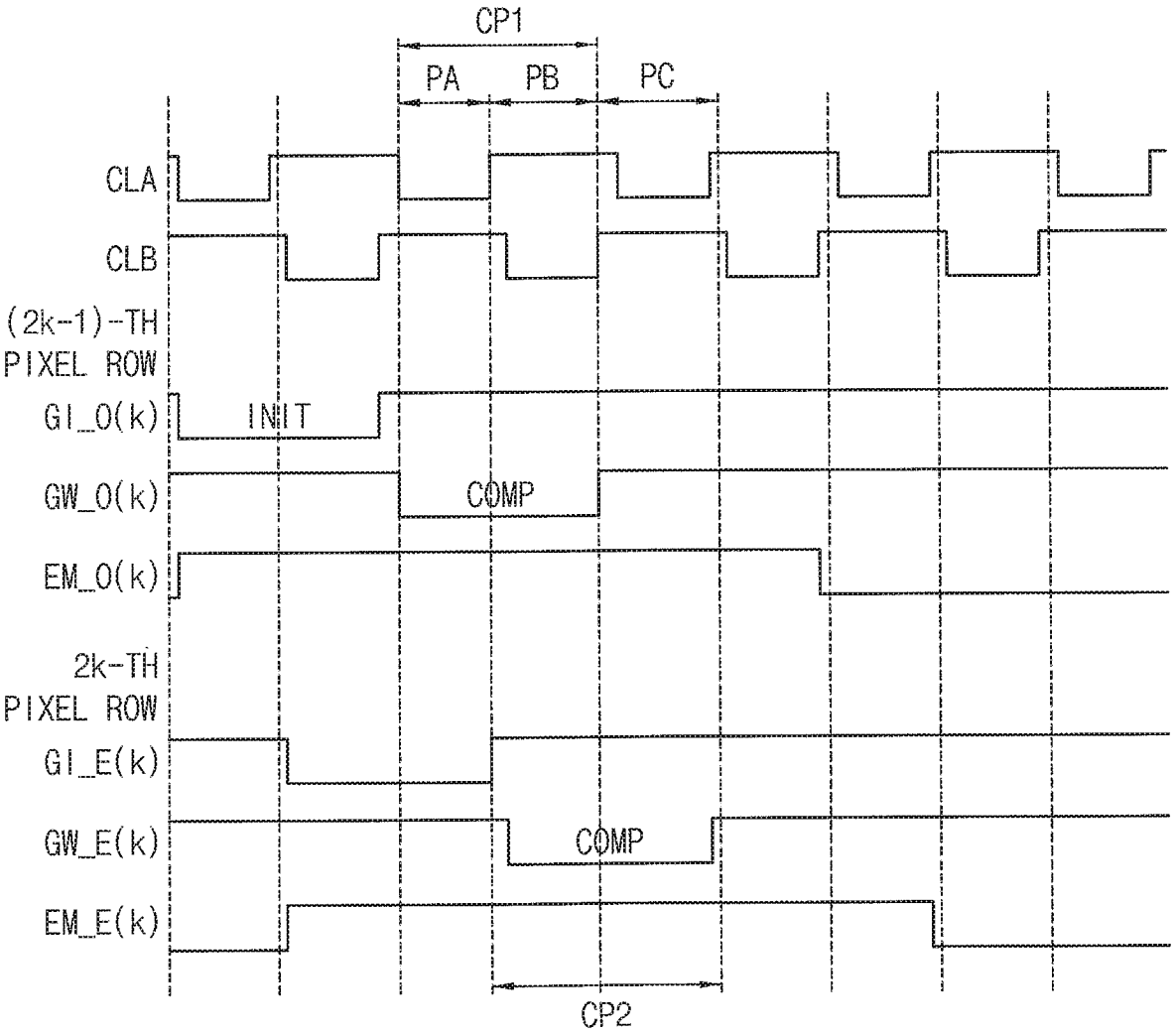
FIG. 19 is a timing diagram illustrating an example of signals for driving the display panel of FIG. 18.

FIG. 17 is a block diagram illustrating an organic light emitting display device according to example embodiments. FIG. 18 is a diagram illustrating an example of a display panel included in the organic light emitting display device of FIG. 17. FIG. 19 is a timing diagram illustrating an example of signals for driving the display panel of FIG. 18.

The organic light emitting display device according to the present example embodiment may be driven by an interlace scan method and may drive each pixel row in common. In addition, the organic light emitting display device does not include a data divider having demultiplexers. Except for above features, the organic light emitting display device according to the present example embodiment is substantially the same as the organic light emitting display device of FIG. 1. Therefore, the same reference numerals will be used to refer to the same or like parts as those described in the previous exemplary embodiment of FIG. 1, and any repetitive explanation concerning the above elements will be omitted.

Referring to FIGS. 17 to 19, the organic light emitting display device may include a display panel 120, a gate driver, a data driver, and a timing controller. The operations of the gate driver, the data driver, and the timing controller are similar or substantially the same as the gate driver, the data driver, and the timing controller of FIG. 1 except for operation timings, and duplicated description will be omitted.

The display panel 120 may be driven by the interlace manner in which odd-numbered pixel rows R1, R3, . . . and even-numbered pixel rows R2, R4, . . . are driven independently at ½ horizontal period intervals.

Odd-numbered pixel rows R1, R3, . . . may be connected to odd-numbered initialization lines GI_OL1, GI_OL2, . . . , odd-numbered gate lines GW_OL1, GW_OL2, . . . , and odd-numbered emission control lines EM_OL1, EM_OL2, . . . . Even-numbered pixel rows R2, R4, . . . may be connected to even-numbered initialization lines GI_EL1, GI_EL2, . . . , even-numbered gate lines GW_EL1, GW_EL2, . . . , and even-numbered emission control lines EM_EL1, EM_EL2, . . . .

The odd-numbered data lines DL1, DL3, . . . may be connected to the odd-numbered pixel rows R1, R3, . . . , respectively. The electrical connection of the odd-numbered data lines DL1, DL3, . . . may be controlled based on the first clock signal CLA. The even-numbered data lines DL2, DL4, . . . may be connected to the even-numbered pixel rows R2, R4, . . . , respectively. The electrical connection of the even-numbered data lines DL2, DL4, . . . may be controlled based on the second clock signal CLB.

The initialization period and the emission period are substantially the same as the operations of FIGS. 4, 5, and 15, and duplicated descriptions will be omitted.

As shown in FIG. 19, the compensation period CP1 of the (2k−1)th pixel row may include a first compensation period PA and a second compensation period PB. For example, FIG. 19 shows that the display device is driven by the interlace manner at 120 Hz frequency.

During the first compensation period PA, the data line may transfer the data voltage to the driving transistor in the sub-pixel in which the diode-connection is formed such that the threshold voltage of the driving transistor is compensated (i.e., the first compensating operation).

During the second compensation period PB, since the first clock signal CLA is deactivated, the data line may be in a floating status. At this time, the threshold voltage compensating operation may be maintained based on the voltage of the floating data line (i.e., the second compensating operation).

In addition, during the second compensation period PB, since the second clock signal CLB is activated, the sub-pixels of the (2k)th pixel row may perform the data writing and threshold voltage compensating operation (i.e., the first compensating operation)

During the third compensation period PC, the data lines connected to the (2k)th pixel rows may be in floating status, and then the threshold voltage compensating operation may be maintained (i.e., the second compensating operation).

As described above, since the first compensating operation and the second compensating operation are performed during the compensation period in the organic light emitting display device driven by the interlaced manner, the threshold voltage compensation time (e.g., longer than two horizontal periods) may be sufficiently secured under a high-frequency driving environment.

The present inventive concept may be applied to an electronic device having the organic light emitting display device. For example, the present inventive concept may be applied to a head mounted display (HMD) device, a TV, a digital TV, a 3D TV, a personal computer, a home electronic device, a notebook computer, a tablet computer, a mobile phone, a smart phone, a PDA, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and features of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An organic light emitting display device comprising:

a display panel including a plurality of pixel groups, each of the pixel groups including a plurality of sub-pixels for each of pixel rows;

a gate driver configured to sequentially provide an initialization signal to the pixel rows, to provide a first group gate signal to first pixel groups of the pixel groups, to provide a second group gate signal overlapping at least a part of the first group gate signal to second pixel groups of the pixel groups, to sequentially provide the first group gate signal to the pixel rows, and to sequentially provide the second group gate signal to the pixel rows, wherein the first and second group gate signals are provided on group gate lines, each group gate line being solely connected to a respective pixel row, wherein, for each adjacent pixel row, the group gate lines are arranged in an opposite connection structure;

an emission control driver configured to sequentially provide an emission control signal to the pixel rows;

a data driver configured to output a data voltage; and a data divider configured to selectively provide the data voltage to data lines connected to the sub-pixels, wherein a first group gate line for providing the first group gate signal is solely connected to the first pixel groups, wherein a second group gate line for providing the second group gate signal is solely connected to the second pixel groups, wherein the first pixel groups correspond to odd-numbered pixel groups, wherein the first group gate signal corresponds to an odd-numbered group gate signal, wherein the second pixel groups correspond to even-numbered pixel groups, and wherein the second group gate signal corresponds to an even-numbered group gate signal.

2. The organic light emitting display device of claim 1, wherein a (k)th even-numbered group gate signal corresponding to a (k)th pixel row is delayed by a ½ horizontal period from a (k)th odd-numbered group gate signal corresponding to the (k)th pixel row, where k is an integer greater than 0.

3. The organic light emitting display device of claim 1, wherein a (k)th odd-numbered group gate signal corresponding to a (k)th pixel row is delayed by a ½ horizontal period from a (k)th even-numbered group gate signal corresponding to the (k)th pixel row, where k is an integer greater than 0.

4. The organic light emitting display device of claim 1, wherein each of the sub-pixels included in the first pixel groups includes:

a first transistor connected between one of the data lines and a first node, the first transistor including a gate electrode configured to receive the odd-numbered group gate signal;

a driving transistor connected between the first node and a second node, the driving transistor including a gate electrode connected to a third node;

a second transistor connected between the second node and the third node, the second transistor including a gate electrode configured to receive the odd-numbered group gate signal;

a third transistor connected between the third node and an initialization power source, the third transistor including a gate electrode configured to receive the initialization signal;

a fourth transistor connected between a first power source and the first node, the fourth transistor including a gate electrode configured to receive the emission control signal;

a fifth transistor connected between the second node and a fourth node, the fifth transistor including a gate electrode configured to receive the emission control signal;

a sixth transistor connected between the initialization power source and the fourth node, the sixth transistor including a gate electrode configured to receive the initialization signal;

a capacitor connected between the first power source and the third node; and an organic light emitting diode (OLED) connected between the fourth node and a second power source configured to provide a voltage lower than a voltage of the first power source.

5. The organic light emitting display device of claim 1, wherein each of the sub-pixels included in the second pixel groups includes:

a first transistor connected between one of the data lines and a first node, the first transistor including a gate electrode configured to receive the even-numbered group gate signal;

a driving transistor connected between the first node and a second node, the driving transistor including a gate electrode connected to a third node;

a second transistor connected between the second node and the third node, the second transistor including a gate electrode configured to receive the even-numbered group gate signal;

a third transistor connected between the third node and an initialization power source, the third transistor including a gate electrode configured to receive the initialization signal;

a fourth transistor connected between a first power source and the first node, the fourth transistor including a gate electrode configured to receive the emission control signal;

a fifth transistor connected between the second node and a fourth node, the fifth transistor including a gate electrode configured to receive the emission control signal;

a sixth transistor connected between the initialization power source and the fourth node, the sixth transistor including a gate electrode configured to receive the initialization signal;

a capacitor connected between the first power source and the third node; and an organic light emitting diode (OLED) connected between the fourth node and a second power source configured to provide a voltage lower than a voltage of the first power source.

6. The organic light emitting display device of claim 5, wherein a single frame period for each of the pixel rows includes an initialization period in which a voltage of the third node and a voltage of the fourth node are simultaneously initialized, a compensation period in which the data voltage is written and a threshold voltage of the driving transistor is compensated after the initialization period, and an emission period in which each of the pixel rows emits light after the compensation period.

7. The organic light emitting display device of claim 6, wherein the first transistor and the second transistor are turned-on during the compensation period, and wherein the compensation period includes:

a first compensation period during which the threshold voltage of the driving transistor is compensated by applying the data voltage to the driving transistor via one of the data lines; and a second compensation period during which the one of the data lines is in a floating state and the operation of compensating the threshold voltage of the driving transistor is maintained.

8. The organic light emitting display device of claim 5, wherein a (k)th odd-numbered group gate line for providing a (k)th odd-numbered group gate signal to a (k)th pixel row is disposed farther from the first and second transistors of the sub-pixels included in the (k)th pixel row than a (k)th even-numbered group gate line for providing a (k)th even-numbered group gate signal to the (k)th pixel row, where k is an integer greater than 0, wherein the (k)th odd-numbered group gate line is connected to the gate electrodes of the first and second transistors included in each of the sub-pixels of the odd-numbered pixel groups by a bridge structure, wherein a (k+1)th even-numbered group gate line for providing a (k+1)th even-numbered group gate signal to a (k+1)th pixel row is disposed farther from the first and second transistors of the sub-pixels included in the (k+1)th pixel row than a (k+1)th odd-numbered group gate line for providing a (k+1)th odd-numbered group gate signal to the (k+1)th pixel row, and wherein the (k+1)th even-numbered group gate line is connected to the gate electrodes of the first and second transistors included in each of the sub-pixels of the even-numbered pixel groups by the bridge structure.

9. The organic light emitting display device of claim 1, wherein a length of an activation period of the first group gate signal and a length of an activation period of the second group gate signal are different from each other.

10. The organic light emitting display device of claim 1, wherein each of the pixel groups includes a first sub-pixel, a second sub-pixel, a third sub-pixel, and a fourth sub-pixel arranged in a first direction in which the pixel rows extend.

11. The organic light emitting display device of claim 10, wherein a first data line connected to the first sub-pixel and a second data line connected to the second sub-pixel extend in a second direction in which pixel columns extend, the first data line and the second data line disposed between the first sub-pixel and the second sub-pixel, wherein a third data line connected to the third sub-pixel and a fourth data line connected to the fourth sub-pixel extend in the second direction, the third data line and the fourth data line disposed between the third sub-pixel and the fourth sub-pixel, and wherein the data lines are not disposed between the second sub-pixel and the third sub-pixel and between the pixel groups.

12. The organic light emitting display device of claim 11, wherein sub-pixels adjacent to each other in the first direction have structures symmetrical in the second direction.

13. An organic light emitting display device comprising:

a display panel including a plurality of pixel groups, each of the pixel groups including a plurality of sub-pixels;

a gate driver configured to provide a first group gate signal to first pixel groups in a first pixel row, to provide a second group gate signal to second pixel groups adjacent to the first pixel groups in the first pixel row, to provide a third group gate signal to third pixel groups in a second pixel row adjacent to the first pixel row, and to provide a fourth group gate signal to fourth pixel groups adjacent to the third pixel groups in the second pixel row, wherein the first, second, third and fourth group gate signals are provided on group gate lines, each group gate line being solely connected to a respective pixel row, wherein, for each adjacent pixel row, the group gate lines are arranged in an opposite connection structure;

an emission control driver configured to provide a first emission control signal to the first pixel row and to provide a second emission control signal to the second pixel row;

a data driver configured to output a data voltage; and a data divider configured to selectively provide the data voltage to a first group data line connected to the first pixel groups, a second group data line connected to the second pixel groups, a third group data line connected to the third pixel groups, and a fourth group data line connected to the fourth pixel groups, wherein a first group gate line for providing the first group gate signal is solely connected to the first pixel groups in the first pixel row, wherein a second group gate line for providing the second group gate signal is solely connected to the second pixel groups in the first pixel row, wherein a third group gate line for providing the third group gate signal is solely connected to the third pixel groups in the second pixel row, wherein a fourth group gate line for providing the fourth group gate signal is solely connected to the fourth pixel groups in the second pixel row, wherein the first pixel row is an odd-numbered pixel row, wherein the second pixel row is an even-numbered pixel row and is adjacent to the first pixel row, wherein each of the first and third pixel groups corresponds to odd-numbered pixel groups, and wherein each of the second and fourth pixel groups corresponds to even-numbered pixel groups.

14. The organic light emitting display device of claim 13, wherein a data writing and threshold voltage compensating operation for the sub-pixels is performed in an order of the first pixel groups of a (2k−1)th pixel row, the second pixel groups of the (2k−1)th pixel row, the fourth pixel groups of a (2k)th pixel row, and the third pixel groups of the (2k)th pixel row, where k is an integer greater than 0.

15. The organic light emitting display device of claim 13, wherein the second group gate signal corresponding to a (2k−1)th pixel row is delayed by a ½ horizontal period from the first group gate signal corresponding to the (2k−1)th pixel row, where k is an integer greater than 0, wherein the fourth group gate signal corresponding to a (2k)th pixel row is delayed by the ½ horizontal period from the second group gate signal corresponding to the (2k−1)th pixel row, and wherein the third group gate signal corresponding to the (2k)th pixel row is delayed by the ½ horizontal period from the fourth group gate signal corresponding to the (2k)th pixel row.

16. The organic light emitting display device of claim 13, wherein a data writing and threshold voltage compensating operation for the sub-pixels is performed in an order of the second pixel groups of a (2k−1)th pixel row, the first pixel groups of the (2k−1)th pixel row, the third pixel groups of a (2k)th pixel row, and the fourth pixel groups of the (2k)th pixel row, where k is an integer greater than 0.

17. The organic light emitting display device of claim 13, wherein a data writing and threshold voltage compensating operation for the sub-pixels are performed in an order of the third pixel groups of a (2k)th pixel row, the fourth pixel groups of the (2k)th pixel row, the second pixel groups of a (2k−1)th pixel row, and the first pixel groups of the (2k−1)th pixel row, where k is an integer greater than 0.

18. The organic light emitting display device of claim 13, wherein a data writing and threshold voltage compensating operation for the sub-pixels are performed in an order of the fourth pixel groups of a (2k)th pixel row, the third pixel groups of the (2k)th pixel row, the first pixel groups of a (2k−1)th pixel row, and the second pixel groups of the (2k−1)th pixel row, where k is an integer greater than 0.

19. The organic light emitting display device of claim 13, wherein a compensation period in which a data writing and threshold voltage compensating operation for the sub-pixels is performed includes:

a first compensation period during which a threshold voltage of a driving transistor is compensated by applying the data voltage to the driving transistor of one of the sub-pixels; and a second compensation period during which a data line corresponding to one of the sub-pixels is in a floating state and the operation of compensating the threshold voltage is maintained.

20. The organic light emitting display device of claim 19, wherein a gate voltage of the driving transistor and an anode voltage of an organic light emitting diode in each of the sub-pixels included in each of pixel rows are simultaneously initialized, and wherein the entire sub-pixels included in each of the pixel rows simultaneously emit light.

21. The organic light emitting display device of claim 13, wherein a first group gate line connected to the first pixel groups of a (2k−1)th pixel row is disposed farther from the (2k−1)th pixel row than a second group gate line connected to the second pixel groups of the (2k−1)th pixel row, where k is an integer greater than 0, wherein the first group gate line is connected to each of the sub-pixels in the first pixel groups by a bridge structure, wherein a fourth group gate line connected to the fourth pixel groups of a (2k)th pixel row is disposed farther from the (2k)th pixel row than a third group gate line connected to the third pixel groups of the (2k)th pixel row, and wherein the fourth group gate line is connected to each of the sub-pixels in the fourth pixel groups by the bridge structure.

22. The organic light emitting display device of claim 13, wherein a second group gate line connected to the second pixel groups of a (2k−1)th pixel row is disposed farther from the (2k−1)th pixel row than a first group gate line connected to the first pixel groups of the (2k−1)th pixel row, where k is an integer greater than 0, wherein the second group gate line is connected to each of the sub-pixels in the second pixel groups by a bridge structure, wherein a third group gate line connected to the third pixel groups of a (2k)th pixel row is disposed farther from the (2k)th pixel row than a fourth group gate line connected to the fourth pixel groups of the (2k)th pixel row, and wherein the third group gate line is connected to each of the sub-pixels in the third pixel groups by the bridge structure.

* * * * *